United States Patent [19]

Takada et al.

[11] Patent Number: 4,666,826

[45] Date of Patent: May 19, 1987

[54] PHOTOGRAPHIC LIGHT-SENSITIVE MATERIAL CONTAINING PHENOLIC COUPLERS AND STABILIZERS

[75] Inventors: Shun Takada; Takashi Kadowaki; Kaoru Onodera, all of Odawara, Japan

[73] Assignee: Konishiroku Photo Industry Co., Ltd., Tokyo, Japan

[21] Appl. No.: 725,338

[22] Filed: Apr. 19, 1985

[30] Foreign Application Priority Data

Apr. 20, 1984 [JP] Japan ..... 59-79947

[51] Int. Cl.[4] ..... G03C 1/40; G03C 7/34

[52] U.S. Cl. ..... 430/549; 430/551

[58] Field of Search ..... 430/549, 551, 552, 553, 430/505

[56] References Cited

U.S. PATENT DOCUMENTS

| | | | |
|---|---|---|---|
| 2,895,926 | 7/1959 | Salminen et al. . | |
| 4,427,767 | 1/1984 | Aoki et al. | 430/549 |
| 4,526,864 | 7/1985 | Takada et al. | 430/551 |
| 4,528,263 | 7/1985 | Sugita et al. | 430/553 |
| 4,537,857 | 8/1985 | Takada et al. | 430/553 |

FOREIGN PATENT DOCUMENTS

| | | |
|---|---|---|
| 112038 | 1/1975 | Japan . |
| 109630 | 2/1978 | Japan . |
| 163537 | 3/1980 | Japan . |

*Primary Examiner*—Richard L. Schilling

*Attorney, Agent, or Firm*—Finnegan, Henderson, Farabow, Garrett & Dunner

[57] ABSTRACT

A silver halide photographic light-sensitive material comprising a support having thereon at least one silver halide emulsion layer, which contains in combination at least one cyan coupler of Formula [I], at least one cyan coupler of Formula [II], and at least one compound of Formula [III], Formula [IV] or Formula [V].

11 Claims, No Drawings

PHOTOGRAPHIC LIGHT-SENSITIVE MATERIAL CONTAINING PHENOLIC COUPLERS AND STABILIZERS

BACKGROUND OF THE INVENTION

1. Field of the Invention

The present invention relates to a silver halide photographic light-sensitive material, and more particularly to a silver halide photographic light-sensitive material which contains cyan couplers excellent in the solubility as well as in the dispersing stability and which is capable of giving a dye image excellent in the color reproducibility as well as in the preservability during its storage over a long period of time.

2. Description of the Prior Art and Problems Thereof

The formation of a dye image by the use of a silver halide photographic light-sensitive material is effected generally in the following process: An aromatic primary amine-type color developing agent itself is oxidized when reducing the imagewise exposed silver halide photographic light-sensitive material's silver halide particles, and the oxidized product of the color developing agent then reacts with a coupler that is in advance contained in the silver halide photographic light-sensitive material to produce a dye image.

As the coupler, in order to make a color reproduction in the subtractive color process, usually three different couplers for the formation of yellow, magenta and cyan dyes are used.

These couplers each is usually dissolved into a substantially water-insoluble high-boiling organic solvent, if necessary, in combination with an auxiliary solvent, to be incorporated into a silver halide emulsion.

The fundamental nature required for each of these couplers includes that it should be well soluble in a high boiling organic solvent, that it should have a satisfactory dispersibility and dispersing stability, i.e., it should hardly deposit in a silver halide emulsion, that it should be excellent in the spectral absorbing characteristic and capable of forming a clear dye image having a satisfactory color tone in an extensive color reproducible range, and that the resulting dye image should be highly resistant to light, heat and moisture. Above all, for the cyan coupler the improvement of the following two points is essential: that the coupler should have almost no absorbability in the wavelength region other than its intrinsic spectrally absorbing wavelength region, and that it should have a satisfactory image preservability such as light resistance, heat resistance, moisture resistance and the like.

The conventionally known cyan couplers include 2,5-diacylaminophenol-type cyan couplers whose phenol is substituted in the second and fifth positions thereof with acylamino groups, which are described in, e.g., U.S. Pat. No. 2,895,826, and Japanese Patent Publication Open to Public Inspection (hereinafter referred to as Japanese Patent O.P.I. Publication) Nos. 112038/1975, 109630/1978 and 163537/1980.

The use of such a 2,5-diacylaminophenol-type cyan coupler, since its secondary absorption in the 400–450 nm region is small, enables to form an image satisfactory in the recolorability as well as in the blue-color reproduction, and also in the anti-dark-discoloration characteristics such as heat resistance, moisture resistance, etc., thus resulting in the formation of a largely improved dye image. However, such features-having 2,5-diacylaminophenol-type cyan coupler has the disadvantages that (1) its spectral minimum density in the 450–480 nm range is so high, while its lightness is so low that the color reproducible range is small, and its absorption in the 500–550 nm range is so high that the green-color reproducibility is deteriorated, (2) its resistance to light is poor, (3) the white background of the resulting image is discolored to be yellowish by light (hereinafter called Y-stain), and (4) the coupler is poor in the solubility and in the dispersing stability; and therefore the coupler does not meet the foregoing fundamental requirements for the nature of a coupler.

OBJECTS OF THE INVENTION

It is a first object of the present invention to provide a silver halide photographic light-sensitive material which contains a cyan coupler capable of forming a dye image excellent in the spectral absorbability as well as in the color tone and very clear in a wide color reproduction range.

It is a second object of the present invention to provide a silver halide photographic light-sensitive material capable of forming a dye image improved to have well-balanced resistances to light, heat and moisture, producing little Y-stain by light, and excellent in the image preservability during its storage over an extensive period of time.

It is a third object of the present invention to provide a silver halide photographic light-sensitive material containing a cyan coupler excellent in the solubility, dispersibility and dispersing stability.

SUMMARY OF THE INVENTION

It has now been found that the above objects are accomplished by the following silver halide photographic light-sensitive material: in a silver halide photographic light sensitive material comprising a support having thereon at least one silver halide emulsion layer, the silver halide photographic light-sensitive material wherein the at least one silver halide emulsion layer comprises in combination at least one of those cyan couplers having the following Formula [I], at least one of those cyan couplers having the following Formula [II], and at least one of those compounds having the following Formula [III], [IV] or [V]; and thus the present invention has been completed.

Formula [I]

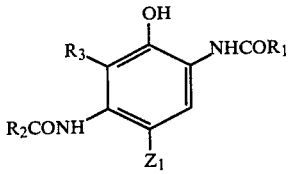

wherein $R_1$ is an alkyl, aryl, cycloalkyl or heterocyclic group; $R_2$ is an alkyl or phenyl group; $R_3$ is a hydrogen atom, a halogen atom, an alkyl or alkoxy group; and $Z_1$ is a hydrogen atom or a group that can be split off by the reaction with the oxidized product of an aromatic primary amine-type color developing agent.

Formula [II]

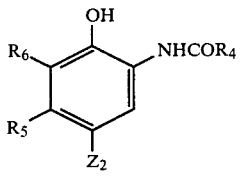

wherein $R_4$ is an alkyl group; $R_5$ is an alkyl group; $R_6$ is a hydrogen atom, a halogen atom, or an alkyl group; $Z_2$ is a hydrogen atom or a group that can be split off by the reaction with the oxidized product of an aromatic primary amine-type color developing agent.

Formula [III]

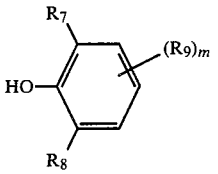

wherein $R_7$ and $R_8$ each is an alkyl group; $R_9$ is an alkyl group, —$NHR_9'$ group, —$SR_9'$ group (wherein $R_9'$ is a monovalent organic group) or —$COOR_9''$ (wherein $R_9''$ is a hydrogen atom or a monovalent organic group); and m is an integer of from zero to 3.

Formula [IV]

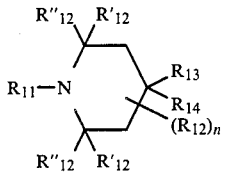

wherein $R_{11}$ is a hydrogen atom, a hydroxyl group, an oxyl radical, —$SOR_{11}'$ group, —$SO_2R_{11}'$ group (wherein $R_{11}'$ is an alkyl or aryl group), an alkyl, hydroxyalkyl, alkenyl, alkinyl, benzyl or —$COR_{11}''$ group (wherein $R_{11}''$ is a hydrogen atom or a monovalent organic group); $R_{12}$, $R_{12}'$ and $R_{12}''$ each is an alkyl group; $R_{13}$ and $R_{14}$ each is a hydrogen atom or a —O-COR''' group (R''' is a monovalent organic group), and $R_{13}$ and $R_{14}$ are allowed in cooperation with each other to form a heterocyclic group; and n is an integer of from zero to 4.

Formula [V]

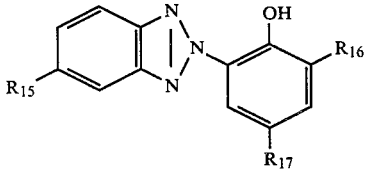

wherein $R_{15}$, $R_{16}$ and $R_{17}$ are allowed to be either the same as or different from one another and each is a hydrogen atom, a halogen atom, a hydroxyl, nitro, alkyl, aryl, alkoxy, aryloxy or alkenyl group.

DETAILED DESCRIPTION OF THE INVENTION

The aryl group represented by the $R_1$ of Formula [I] is, e.g., a phenyl group, a naphthyl group, etc., and preferably a phenyl group; the heterocyclic group represented by the $R_1$ is, e.g., a pyridyl group, a furan group, etc.; and the cycloalkyl group represented by the $R_1$ is, e.g., a cyclopropyl group, a cyclohexyl group, etc. These groups each represented by the $R_1$ is allowed to have a single substituent or a plurality of substituents; for example, typical substituents introducible to the phenyl group include halogen atoms (e.g., fluorine, chlorine, bromine, etc.), alkyl groups (such as methyl, ethyl, propyl, butyl, dodecyl, etc.), hydroxyl group, cyano group, nitro group, alkoxy groups (such as methoxy, ethoxy, etc.), alkylsulfonamido groups (such as methylsulfonamido, octylsulfonamido, etc.), arylsulfonamido groups (such as phenylsulfonamido, naphthylsulfonamido, etc.), alkylsulfamoyl groups (such as butylsulfamoyl), arylsulfamoyl groups (such as phenylsulfamoyl), alkyloxycarbonyl groups (such as methyloxycarbonyl), aryloxycarbonyl groups (such as phenyloxycarbonyl), aminosulfonamido group, acylamino groups, carbamoyl group, sulfonyl group, sulfinyl group, sulfoxy group, sulfo group, aryloxy groups, alkoxy groups, carboxy group, alkyl-carbonyl groups, aryl-carbonyl groups, aminocarbonyl group, and the like. Two different ones of these substituents are allowed to be introduced to the phenyl group. The preferred group represented by the $R_1$ is a phenyl group or a phenyl group having one or more substituents including halogen atoms, alkylsufonamido, arylsulfonamido, alkylsulfamoyl, arylsulfamoyl, alkylsulfonyl, arylsulfonyl, alkylcarbonyl, arylcarbonyl and cyano groups.

The alkyl group represented by the $R_2$ is a straight-chain or branched-chain alkyl group such as methyl, ethyl, propyl, butyl or octyl group.

In the present invention, the preferred cyan couplers having Formula [I] are those compounds having the following Formula [VI]:

Formula [VI]

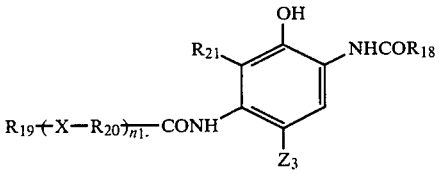

wherein $R_{18}$ is a phenyl group. The phenyl group is allowed to have a single substituent or a plurality of substituents. Typical substituents introducible include halogen atoms (such as fluorine, chlorine, bromine), alkyl groups (such as methyl, ethyl, propyl, butyl, octyl, dodecyl, etc.), hydroxyl group, cyano group, nitro group, alkoxy groups (such as methoxy, ethoxy, etc.), alkylsulfonamido groups (such as methylsulfonamido, octylsulfonamido, etc.), arylsulfonamido groups (such as phenylsulfonamido, naphthylsulfonamido, etc.), alkylsulfamoyl groups (such as butylsulfamoyl), arylsulfamoyl groups (such as phenylsulfamoyl), alkyloxycarbonyl groups (such as methyloxycarbonyl), aryloxycarbonyl groups (such as phenyloxycarbonyl), and the like. The phenyl group may have not less than two of these substituents. The preferred group represented by the $R_{18}$ is a phenyl group or a phenyl group having one or more of substituents including halogen atoms (preferably fluorine, chlorine, and bromine), alkylsulfonamido groups (preferably O-methylsulfonamido, P-octylsulfonamido, and O-dodecylsulfonamido), arylsulfonamido groups (preferably phenylsulfonamido), alkylsulfamoyl groups (preferably butylsulfamoyl), arylsulfamoyl groups (preferably phenylsulfamoyl), alkyl groups (preferably methyl and trifluoromethyl), and alkoxy groups (preferably methoxy and ethoxy).

$R_{19}$ is an alkyl group or an aryl group. The alkyl or aryl group is allowed to have a single substituent or a plurality of substituents. Typical substituents include halogen atoms (such as fluorine, chlorine, bromine), hydroxyl group, carboxyl group, alkyl groups (such as methyl, ethyl, propyl, butyl, octyl, dodecyl, etc.), aralkyl groups, cyano group, nitro group, alkoxy groups (such as methoxy, ethoxy, etc.), aryloxy groups, alkylsulfonamido groups (such as methylsulfonamido, octylsulfonamido, etc.), arylsulfonamido groups (such as phenylsulfonamido, naphthylsulfonamido, etc.), alkylsulfamoyl groups (such as butylsulfamoyl), arylsulfamoyl groups (such as phenylsulfamoyl), alkyloxycarbonyl groups (such as methyloxycarbonyl), aryloxycarbonyl groups (such as phenyloxycarbonyl), aminosulfonamido groups (such as dimethylaminosulfonamido), alkylsulfonyl groups, arylsulfonyl groups, alkylcarbonyl groups, arylcarbonyl groups, aminocarbonylamido group, carbamoyl group, sulfinyl group, and the like. The phenyl group may have not less than two of these substituents.

The preferred group represented by the $R_{19}$, when $n_1=0$, is an alkyl group and, when $n_1$ is equal to or more than 1, is an aryl group. The more preferred group represented by the $R_{19}$, when $n_1=0$, is an alkyl group having from 1 to 22 carbon atoms (preferably methyl, ethyl, propyl, butyl, octyl, dodecyl) and, when $n_1$ is equal to or more than 1, is a phenyl group or a phenyl group having one or more of substituents including alkyl groups (preferably t-butyl, t-amyl, octyl), alkylsulfonamido groups (preferably butylsulfonamido, octylsulfonamido, dodecylsulfonamido), arylsulfonamido groups (preferably phenylsulfonamido), aminosulfonamido groups (preferably dimethylaminosulfonamido), and alkyloxycarbonyl groups (preferably methyloxycarbonyl, butyloxycarbonyl).

$R_{20}$ is an alkylene group, preferably a straight-chain or branched-chain alkylene group having from 1 to 20 carbon atoms, and more preferably an alkylene group having from 1 to 12 carbon atoms.

$R_{21}$ is a hydrogen atom or a halogen atom (fluorine, chlorine, bromine or iodine), and preferably a hydrogen atom.

$n_1$ is zero or an integer, and preferably zero or 1.

X is a divalent group such as —O—, —CO—, —COO—, —OCO—, —$SO_2$NR—, —NR'$SO_2$NR''—, —S—, —SO— or —$SO_2$— (wherein R' and R'' each is an alkyl group which is allowed to have a substituent). The preferred one as the X is a —O—, —S—, —SO— or —$SO_2$— group.

$Z_3$ is a hydrogen atom or a group that can be split off by the reaction with the oxidized product of an aromatic primary amine-type color developing agent, and preferably a chlorine atom or a fluorine atom.

The following are typical examples of those cyan couplers having Formula [I], but the present invention is not limited by the examples.

I-1

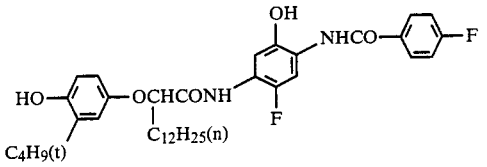

I-2

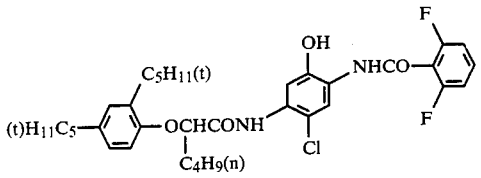

I-3

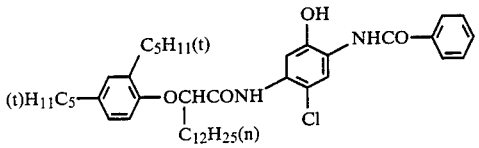

I-4

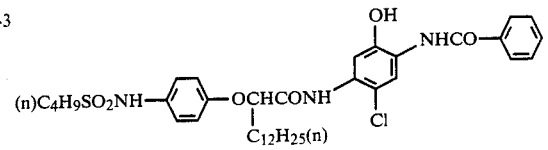

I-5

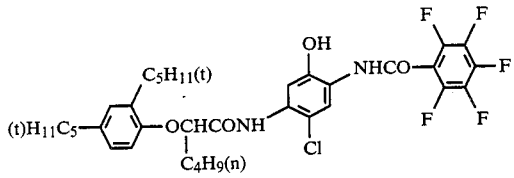

I-6

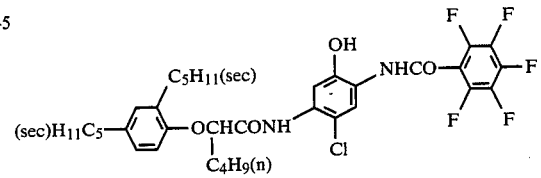

I-7

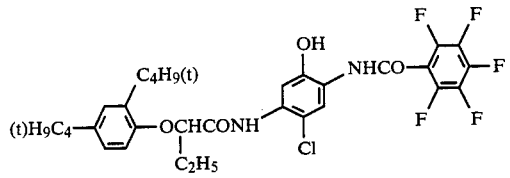

I-8

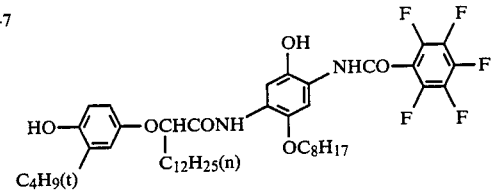

I-9

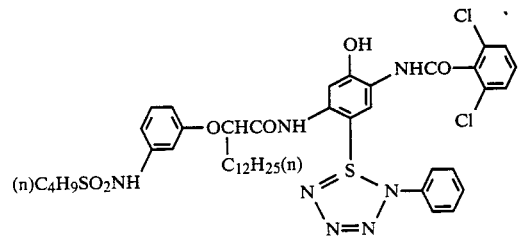

I-10

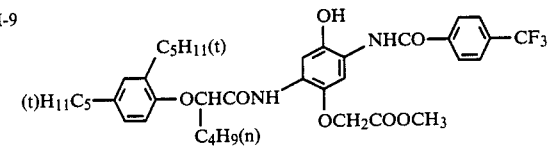

-continued
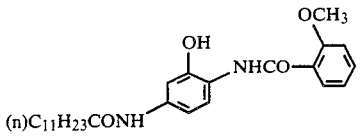
I-11
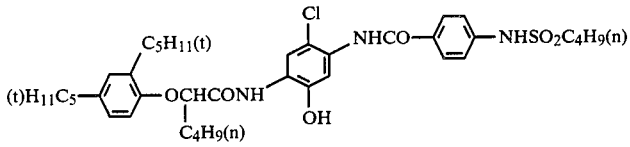
I-12
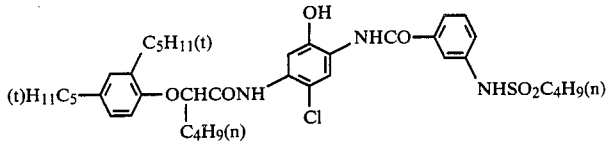
I-13
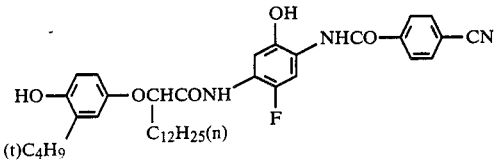
I-14
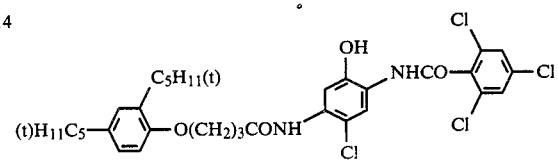
I-15
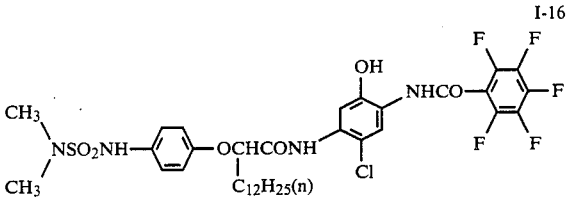
I-16
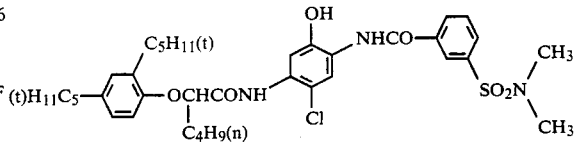
I-17
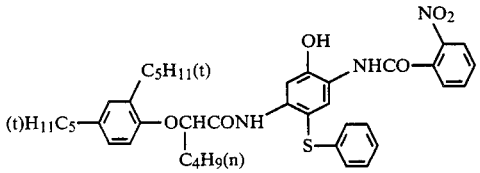
I-18
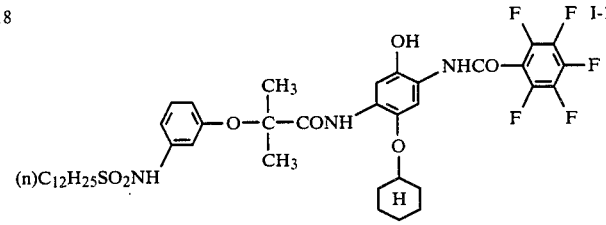
I-19
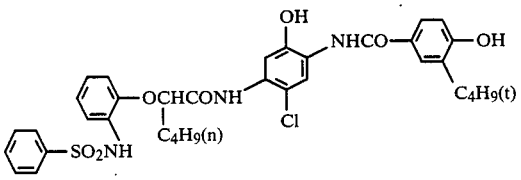
I-20
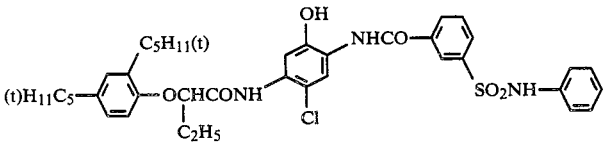
I-21
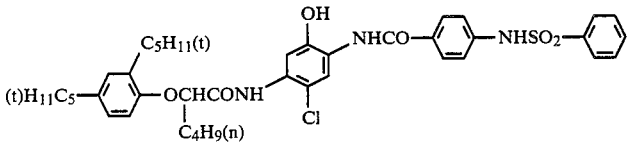
I-22

-continued
I-23
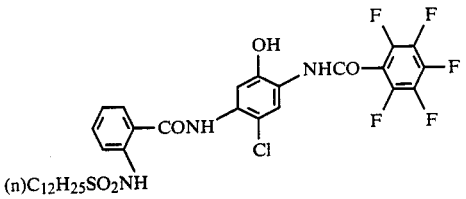
I-24
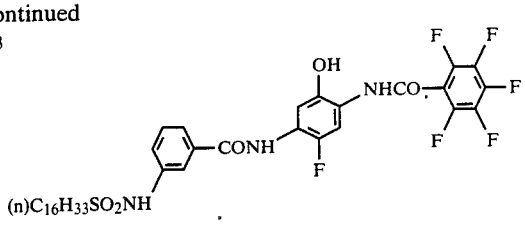
I-25
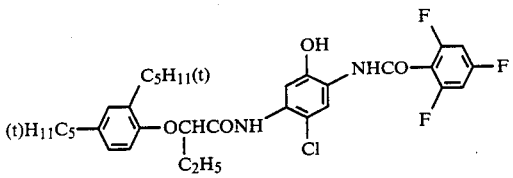
I-26
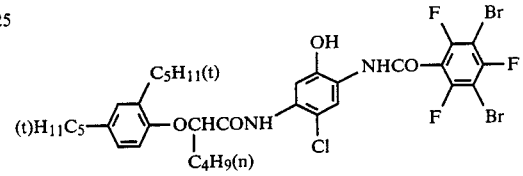
I-27
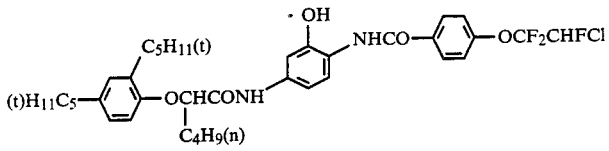
I-28
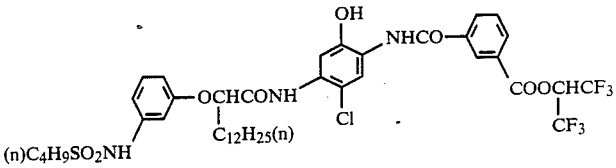
I-29
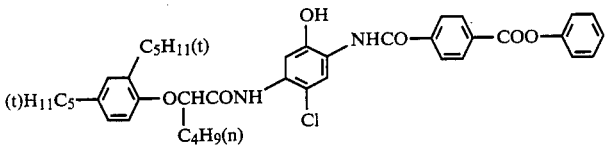
I-30
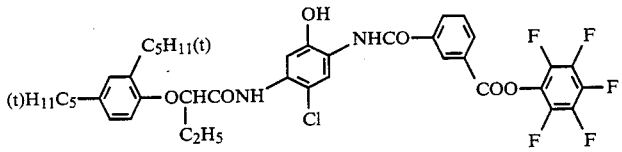
I-31
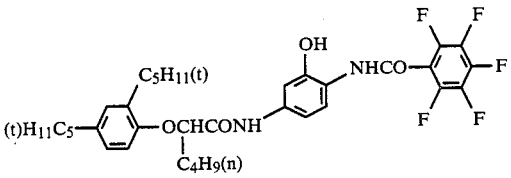
I-32
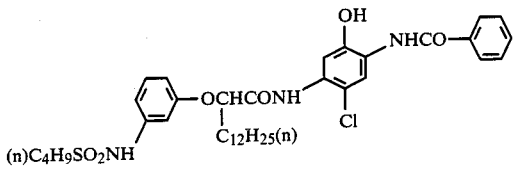
I-33
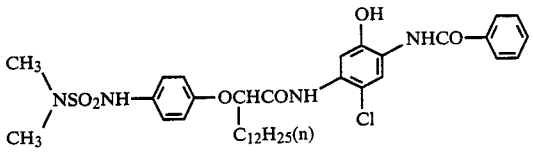
I-34
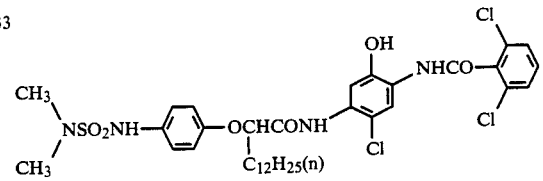
I-35
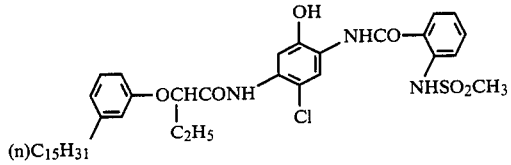
I-36
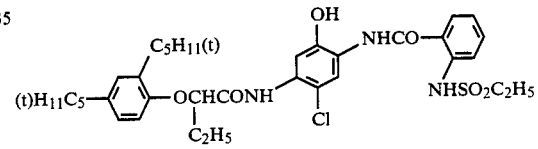

-continued

I-37

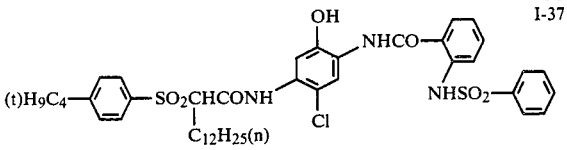

I-38

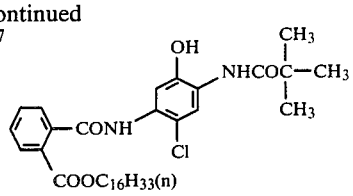

I-39

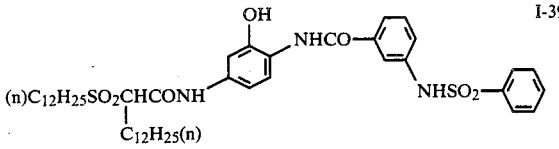

I-40

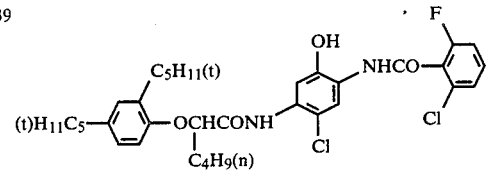

I-41

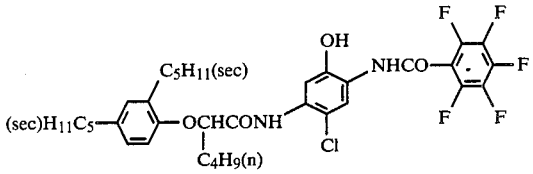

I-42

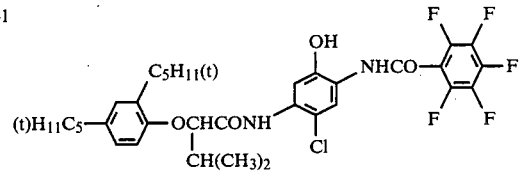

I-43

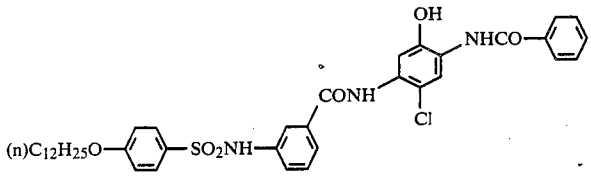

I-44

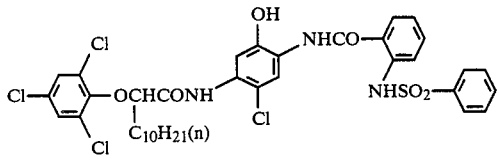

I-45

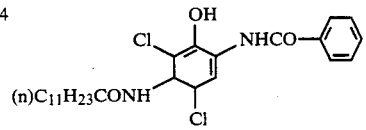

I-46

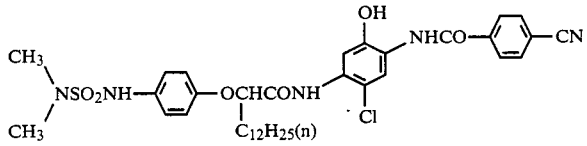

In the present invention, the cyan couplers having Formula [II] are preferably those represented by the following Formula [VII]:

Formula [VII]

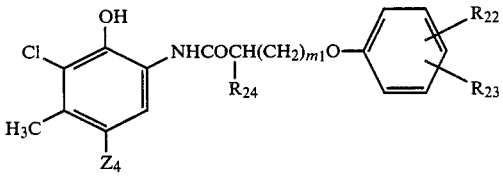

wherein $R_{22}$ and $R_{23}$ may be either the same as or different from each other and each is a hydrogen atom, an alkyl group (such as methyl, ethyl, propyl, butyl, amyl, octyl, dodecyl, etc.), or an alkoxy group (such as methoxy, ethoxy, etc.), provided the sume of the number of carbon atoms of the $R_{22}$ and $R_{23}$ is from 8 to 16. More preferably, the $R_{22}$ and $R_{23}$ each is a butyl or amyl group. $R_{24}$ is a hydrogen atom or an alkyl group (such as methyl, ethyl, butyl, octyl, etc.), and preferably a hydrogen atom, an ethyl or butyl group. $m_1$ is an integer of from zero to 2. $Z_4$ is a hydrogen atom or a group that can be split off by the reaction with the oxidized product of an aromatic primary amine-type color developing agent.

In Formulas [I], [II], [VI] and [VII], the group that can be split off by the reaction with the oxidized product of an aromatic primary amine-type color developing agent is well-known to those skilled in the art, and when present in a coupler-containing coated layer or in other layers of a silver halide photographic light-sensitive material, improves the reactivity of the coupler or splits off from the coupler to function as a development inhibitor, bleach inhibitor, color corrector, etc., to thereby advantageously act for the above layers. Typical examples of the group includes halogen atoms, alkoxy groups, aryloxy groups, arylazo groups, thioether groups, carbamoyl groups, acyloxy groups, imido groups, sulfonamido groups, thiocyano group and heterocyclic groups (such as oxazolyl, diazolyl, triazolyl, tetrazolyl), and the like. Particularly suitable examples represented by the Z are a hydrogen atom and a chlorine atom.

The following are typical examples of those cyan couplers having Formula [II], but the present invention is not limited by the examples.

II-1
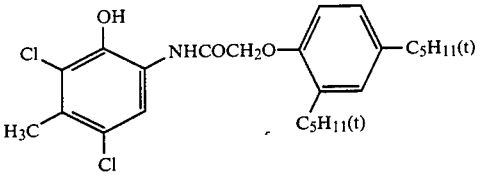
II-2
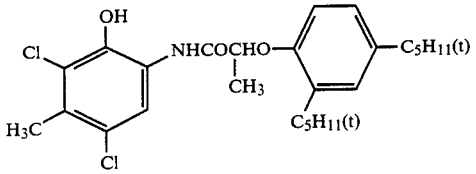
II-3
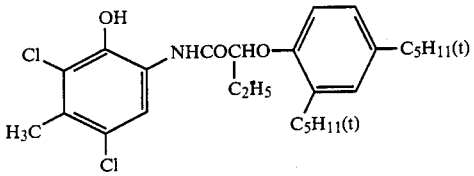
II-4
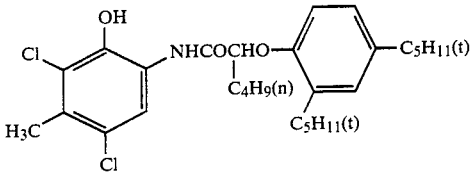
II-5
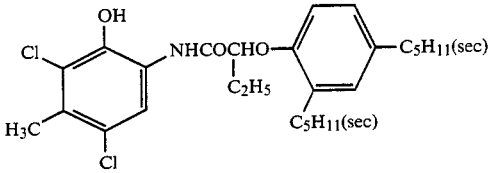
II-6
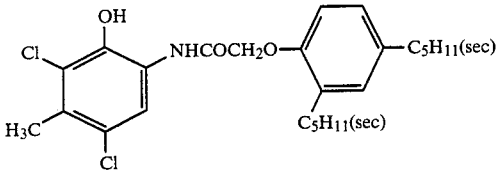
II-7
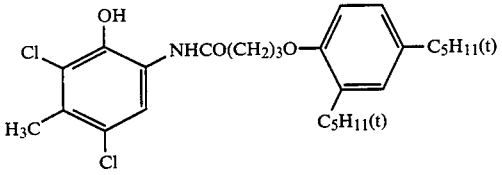
II-8
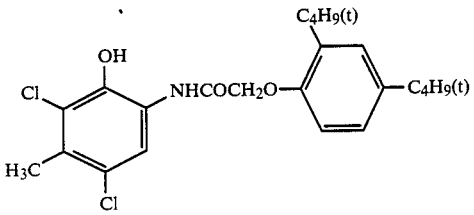
-continued
II-9
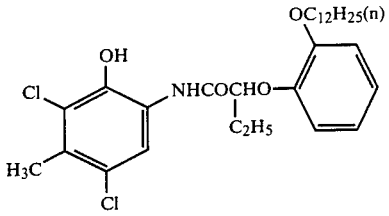
II-10
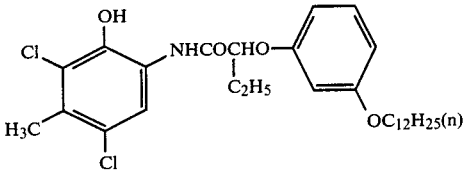
II-11
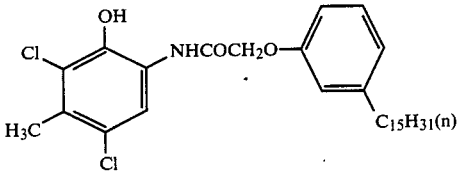
II-12
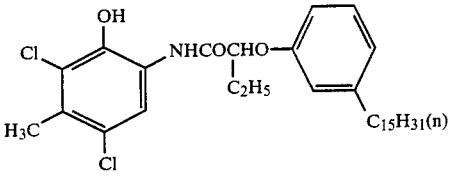
II-13
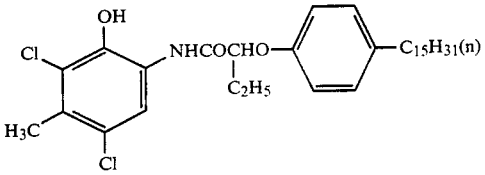
II-14
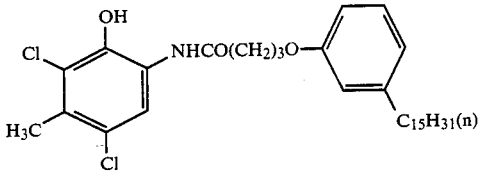
II-15
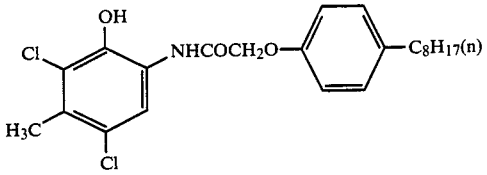
II-16
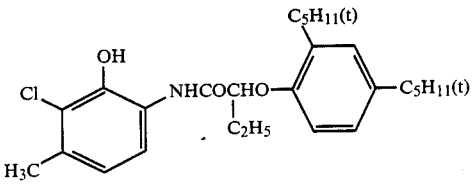

-continued

II-17

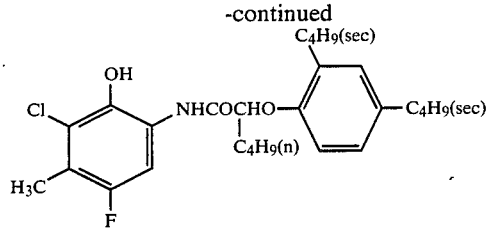

II-18

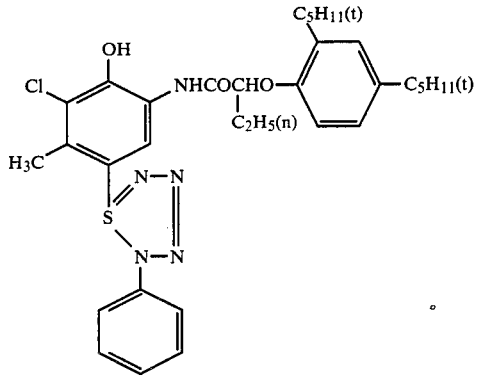

II-19

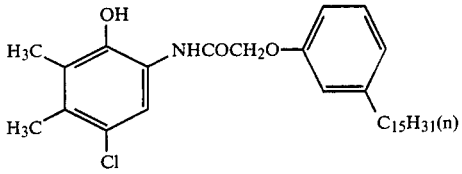

II-20

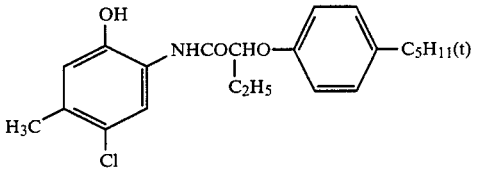

In the case where these cyan couplers of this invention having Formula [I] and these cyan couplers of this invention having Formula [II] are used in combination, at least one of the cyan couplers having Formula [I] and at least one of the cyan couplers having Formula [II] may be used in combination in an arbitrary proportional quantities. In this instance, the using quantity of the cyan coupler having Formula [I] should account for from 30 to 95 mole% of the whole quantity of these combined cyan couplers, and more preferably from 50 to 90 mole%.

In this invention, the alkyl group represented by the $R_7$ and $R_8$ of Formula [III] is preferably an alkyl group having from 1 to 12 carbon atoms, and more preferably a branched-chain-in-the-α-position alkyl group having from 3 to 8 carbon atoms. The $R_7$ and $R_8$ each is particularly preferably a t-butyl group or a t-pentyl group.

The alkyl group represented by the $R_9$ is a straight-chain or branched-chain alkyl group such as methyl, ethyl, propyl, butyl, pentyl, octyl, nonyl, dodecyl, octadecyl, or the like. Where the alkyl has a substituent or substituents, the substituent includes halogen atoms, hydroxyl group, nitro group, cyano group, aryl groups (such as phenyl, hydroxyphenyl, 3,5-t-butyl-4-hydroxyphenyl, 3,5-di-t-pentyl-4-hydroxyphenyl, etc.), amino groups (such as dimethylamino, diethylamino, 1,3,5-triazinylamino, etc.), alkyloxycarbonyl groups (such as methoxycarbonyl, ethoxycarbonyl, propyloxycarbonyl, butoxycarbonyl, pentyloxycarbonyl, octyloxycarbonyl, nonyloxycarbonyl, dodecyloxycarbonyl, octadecyloxycarbonyl, etc.), aryloxycarbonyl groups (such as phenoxycarbonyl), carbamoyl groups (e.g., alkylcarbamoyl groups such as methylcarbamoyl, ethylcarbamoyl, propylcarbamoyl, butylcarbamoyl, heptylcarbamoyl, etc., arylcarbamoyl groups such as phenylcarbamoyl, etc., cycloalkylcarbamoyl groups such as cyclohexylcarbamoyl, etc.), and heterocyclic groups such as isocyanuryl, 1,3,5-triazinyl, etc. The amino group represented by the $R_9$ includes, e.g., alkylamino groups such as dimethylamino, diethylamino, methyl-ethylamino, etc., arylamino groups such as phenylamino, hydroxylphenylamino, etc., cycloalkylamino groups such as cyclohexyl, etc., heterocyclic amino groups such as 1,3,5-triazinylamino, isocyanuryl, etc., and the like. The monovalent organic group represented by the $R_9'$ and $R_9''$ includes, e.g., alkyl groups (such as methyl, ethyl, propyl, butyl, amyl, decyl, dodecyl, hexadecyl, octadecyl, etc.), aryl groups (such as phenyl, naphthyl, etc.), cycloalkyl group (such as cyclohexyl, etc.), and heterocyclic groups (such as 1,3,5-triazinyl, isocyanuryl, etc.). Where these organic groups each has a substituent or substituents, the substituent includes, e.g., halogen atoms (such as fluorine, chlorine, bromine), hydroxyl group, nitro group, cyano group, amino group, alkyl groups (such as methyl, ethyl, i-propyl, t-butyl, t-amyl, etc.), aryl groups (such as phenyl, tolyl, etc.), alkenyl groups (such as allyl, etc.), alkylcarbonyloxy groups (such as methylcarbonyloxy, ethylcarbonyloxy, benzylcarbonyloxy, etc.), arylcarbonyloxy groups (such as benzoyloxy, etc.), and the like.

The preferred compounds having formula [III] are those represented by the following Formula [VIII]:

Formula [VIII]

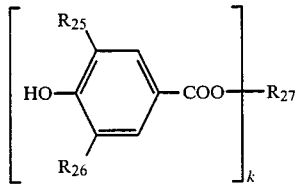

wherein $R_{25}$ and $R_{26}$ each is a straight-chain or branched-chain alkyl group having from 3 to 8 carbon atoms, such as particularly t-butyl or t-pentyl group, and $R_{27}$ is a k-valent organic group, where k is an integer of from 1 to 6.

The k-valent organic group represented by the $R_{27}$ includes alkyl groups such as methyl, ethyl, propyl, butyl, pentyl, octyl, hexadecyl, methoxyethyl, chloromethyl, 1,2-dibromoethyl, 2-chloroethyl, benzyl, phenethyl, etc., alkenyl groups such as allyl, propenyl, butenyl, etc., polyvalent unsaturated hydrocarbon groups such as ethylene, trimethylene, propylene, hexamethylene, 2-chlorotrimethylene, etc., unsaturated hydrocarbon groups such as glyceryl, diglyceryl, pentaerythrityl, dipentaerythrityl, etc., alicyclic hydrocarbon groups such as cyclopropyl, cyclohexyl, cyclohexenyl, etc., aryl groups such as phenyl, P-octyl-phenyl, 2,4-dimethyl-phenyl, 2,4-di-t-butyl-phenyl, 2,4-di-t-pentyl-phenyl, P-chlorophenyl, 2,4-dibromophenyl, naphthyl, etc., arylene groups such as 1,2-, 1,3- or 1,4-phenylene, 3,5-dimethyl-1,4-phenylene, 2-t-butyl-1,4-phenylene, 2-chloro-1,4-phenylene, naphthalene, etc., 1,3,5-trisubstituted benzene groups, and the like.

The $R_{27}$, in addition to the above groups, includes also those k-valent organic groups combined through —O—, —S— or —$SO_2$— with any arbitrary one of the above groups.

The more preferred groups represented by the $R_{27}$ are 2,4-di-t-butyl-phenyl, 2,4-di-t-pentyl-phenyl, P-octyl-phenyl, P-dodecyl-phenyl, 3,5-di-t-butyl-4-hydroxyphenyl, and 3,5-di-t-pentyl-4-hydroxyphenyl groups. The preferred k is an integer of from 1 to 4.

The following are examples of the compounds having Formula [III], but the present invention is not limited by the examples.

III-1

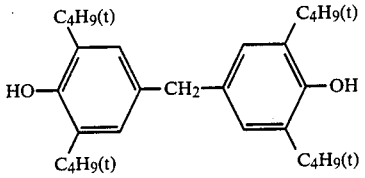

III-2

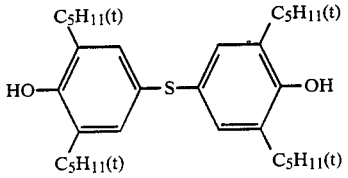

III-3

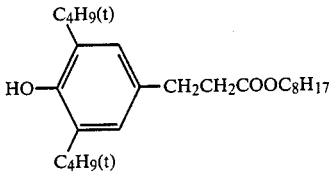

III-4

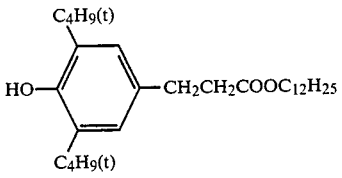

III-5

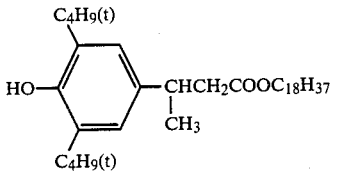

III-6

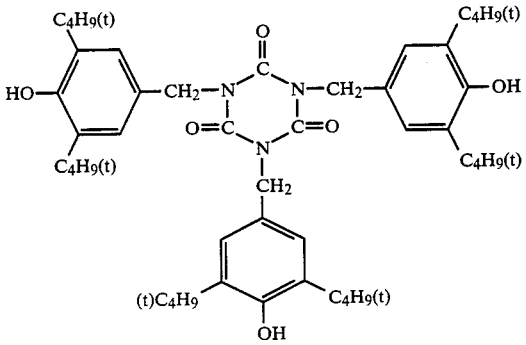

-continued

III-7

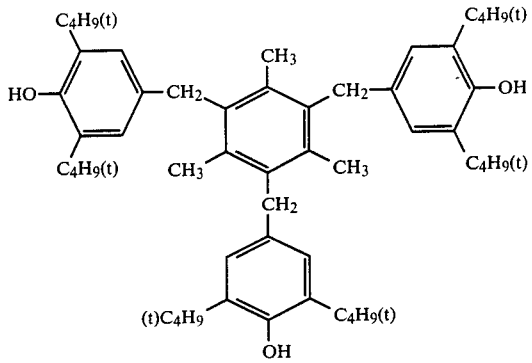

III-8

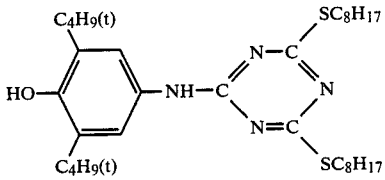

III-9

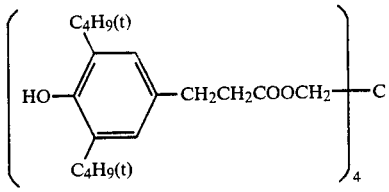

III-10

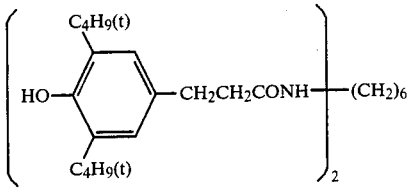

III-11

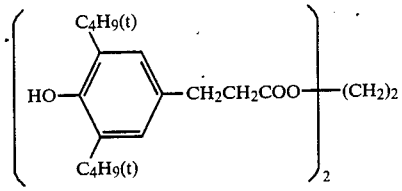

III-12

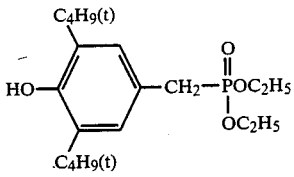

III-13

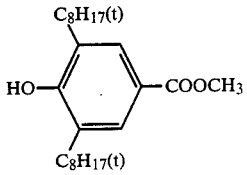

-continued
III-14
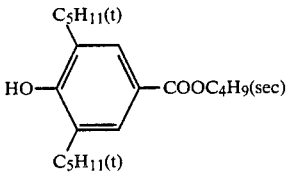
III-15
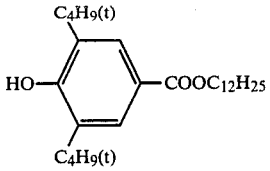
III-16
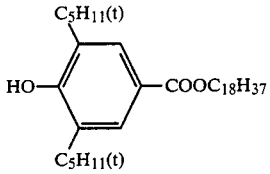
III-17
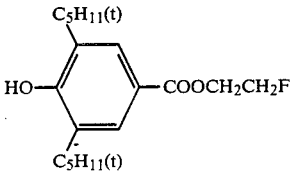
III-18
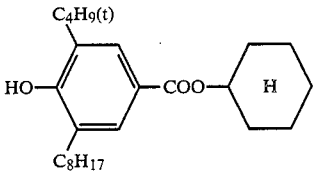
III-19
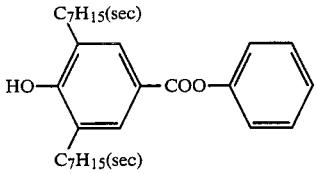
III-20
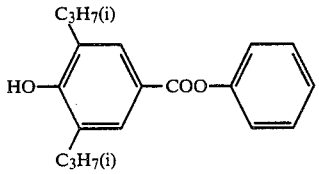
III-21
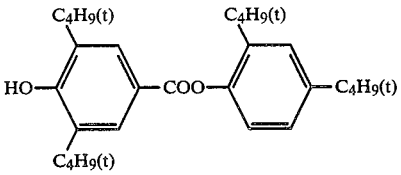
III-22
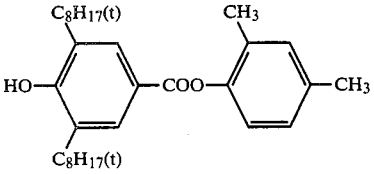
-continued
III-23
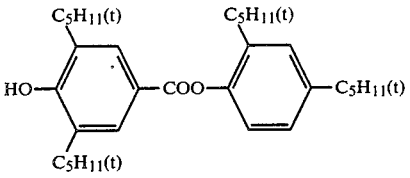
III-24
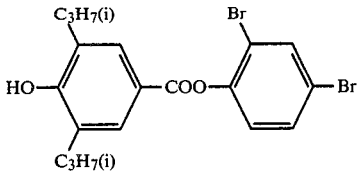
III-25
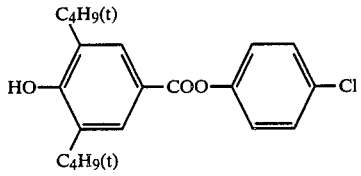
III-26
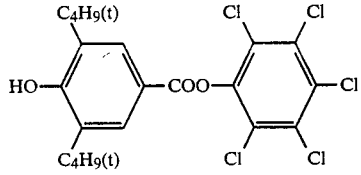
III-27
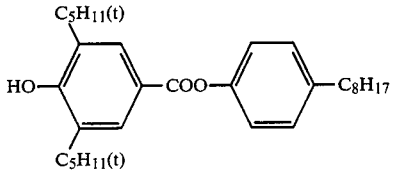
III-28
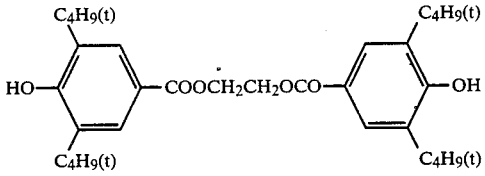
III-29
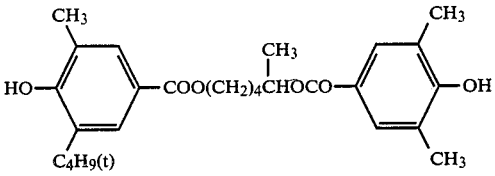
III-30
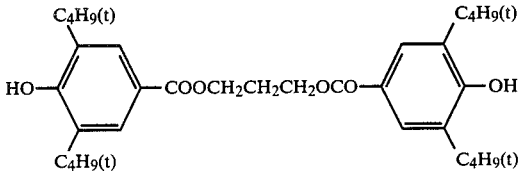

-continued

III-31

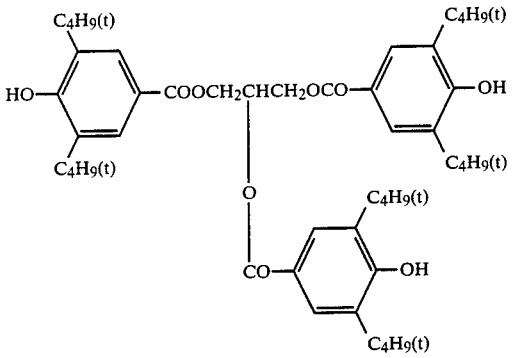

III-32

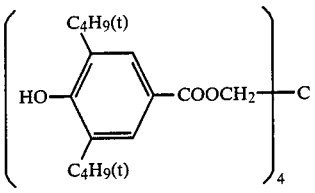

III-33

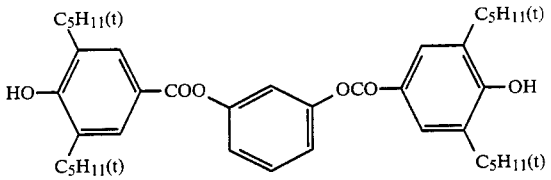

III-34

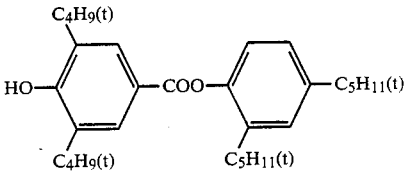

III-35

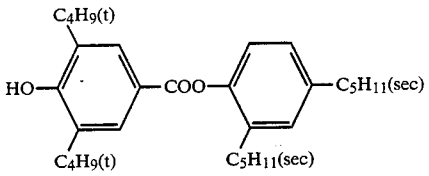

III-36

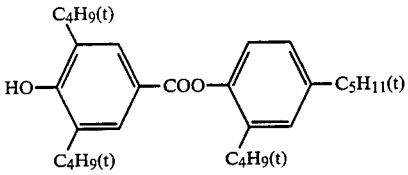

III-37

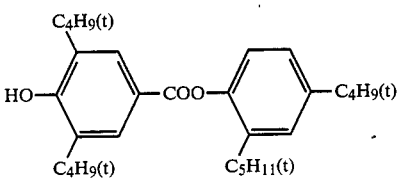

-continued

III-38

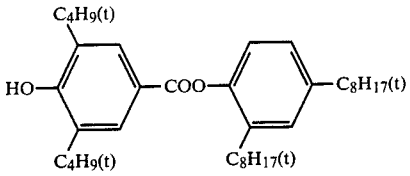

III-39

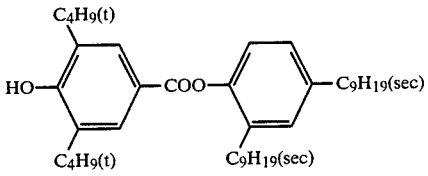

III-40

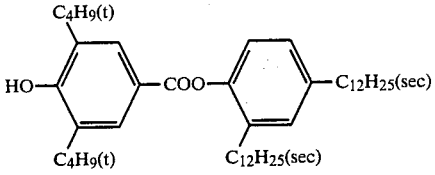

III-41

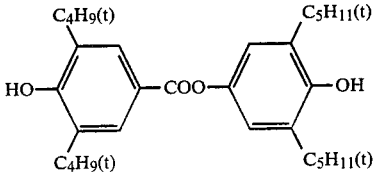

III-42

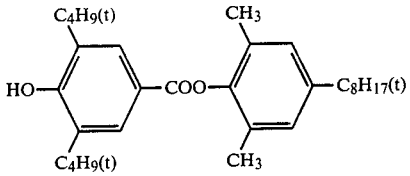

III-43

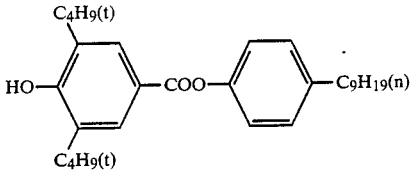

III-44

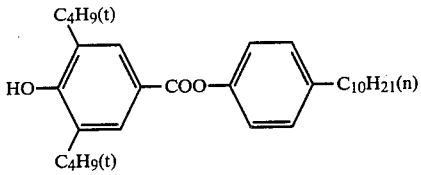

In this invention, the alkyl group represented by the $R_{11}$ of Formula [IV] has from 1 to 12 carbon atoms, and the alkenyl or alkinyl group has from 2 to 4 carbon atoms. The preferred group represented by the $R_{11}$ is a hydrogen atom, an alkyl group (such as methyl, ethyl, propyl, butyl, chloromethyl, hydroxymethyl, benzyl, etc.), an alkenyl group (such as vinyl, allyl, isopropenyl, etc.), an alkynyl group (such as ethynyl, propynyl, etc.), or —$COR_{11}''$, where $R_{11}''$ is, e.g., an alkyl group (such as methyl, ethyl, propyl, butyl, benzyl, etc.), an alkenyl group (such as vinyl, allyl, isopropenyl, etc.), an alkynyl group (such as ethynyl, propynyl, etc.), or an aryl group (such as phenyl, tolyl, etc.).

The preferred alkyl group represented by each of the $R_{12}$, $R_{12}'$ and $R_{12}''$ is a straight-chain or branched-chain alkyl group having from 1 to 5 carbon atoms, and is particularly preferably a methyl group.

In the $R_{13}$ and $R_{14}$, the monovalent organic group represented by the R''' is, e.g, an alkyl group (such as methyl, ethyl, propyl, butyl, pentyl, octyl, dodecyl, octadecyl, etc.), an alkenyl group (such as vinyl, etc.), an alkynyl group (such as ethynyl, etc.), an aryl group (such as phenyl, naphthyl, etc.), an alkylamino group (such as ethylamino, etc.), an arylamino group (such as anilino, etc.), or the like. The heterocyclic group formed by the $R_{13}$ and $R_{14}$ together is, e.g.,

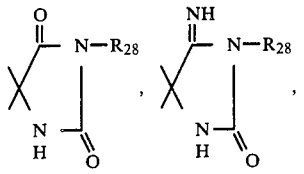

or the like, (wherein $R_{28}$ is a hydrogen atom, an alkyl, cycloalkyl, or phenyl group).

In this invention, the preferred compounds having Formula [IV] are those represented by the following Formula [IX]:

Formula [IX]

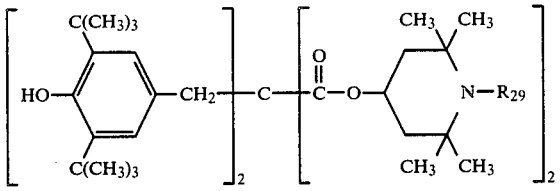

wherein $R_{29}$ is an alkyl group (such as methyl, ethyl, propyl, butyl, pentyl, benzyl, etc.), an alkenyl group (such as vinyl, allyl, isopropenyl, etc.), an alkynyl group (such as ethynyl, propynyl, etc.) or an acyl group (such as formyl, acetyl, propionyl, butyryl, acryloyl, propioloyl, methacryloyl, crotonoyl, etc.).

The more preferred group represented by the $R_{29}$ is a methyl, ethyl, vinyl, allyl, propinyl, benzyl, acetyl, propionyl, acryloyl, methacryloyl or crotonoyl group.

The following are examples of the compounds having Formula [IV], but the present invention is not limited by the examples.

IV-1

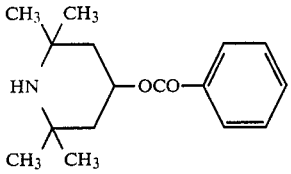

IV-2

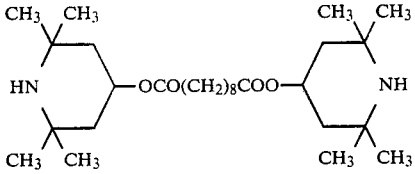

IV-3

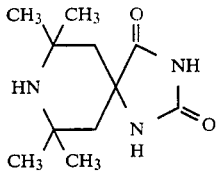

IV-4

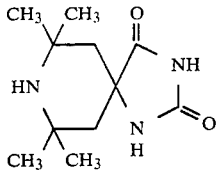

IV-5

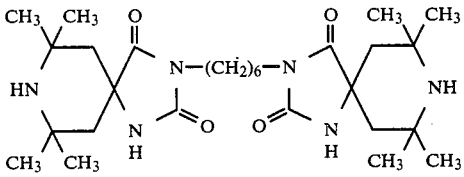

IV-6

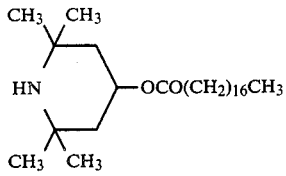

IV-7

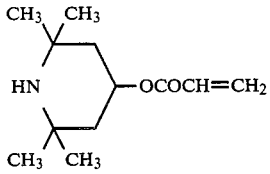

IV-8

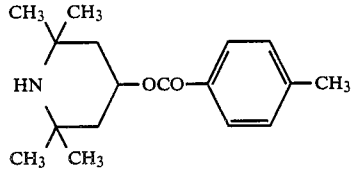

IV-9

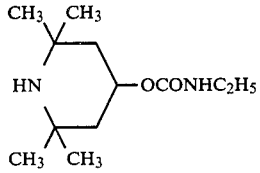

IV-10

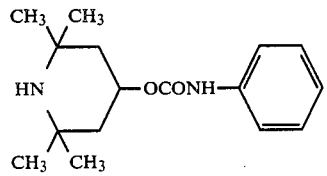

-continued
IV-11
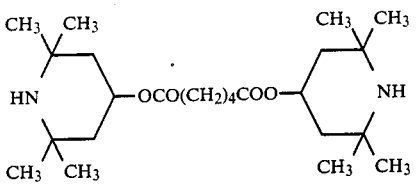
IV-12
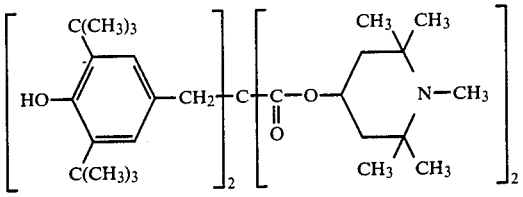
IV-13
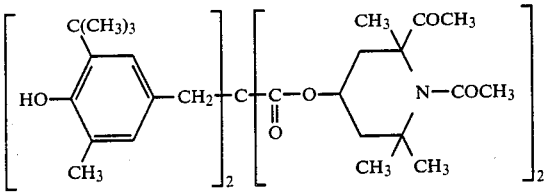
IV-14
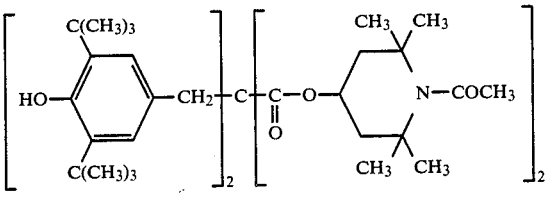
IV-15
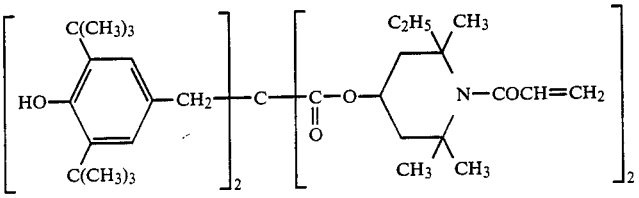
IV-16
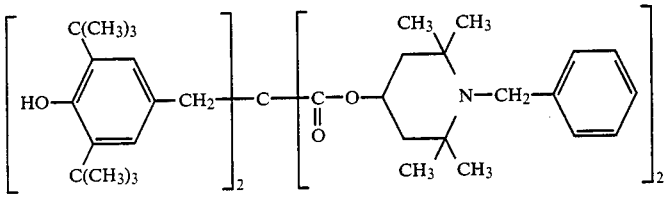
IV-17
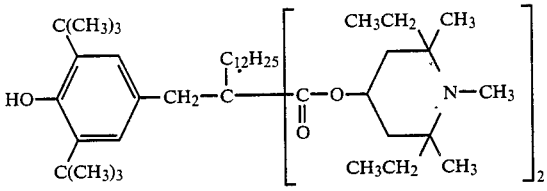
IV-18
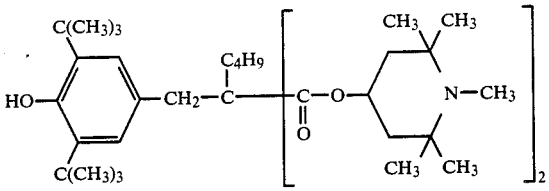
IV-19
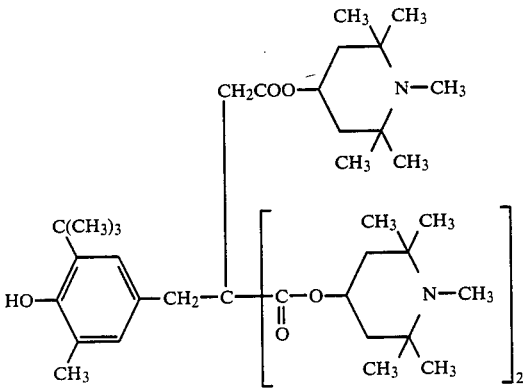

-continued
IV-20
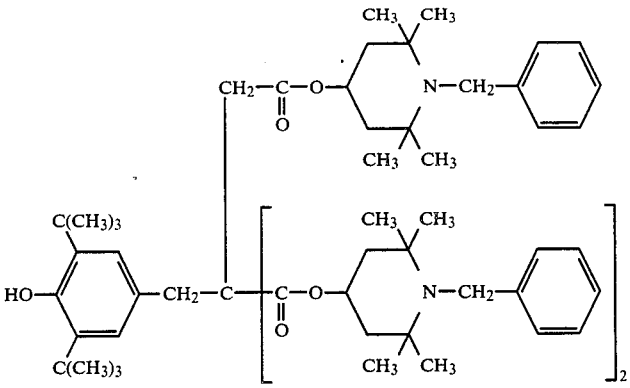
IV-21
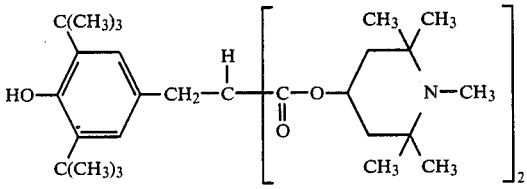
IV-22
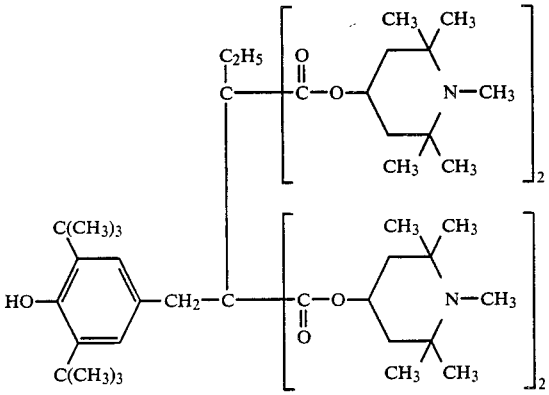
IV-23
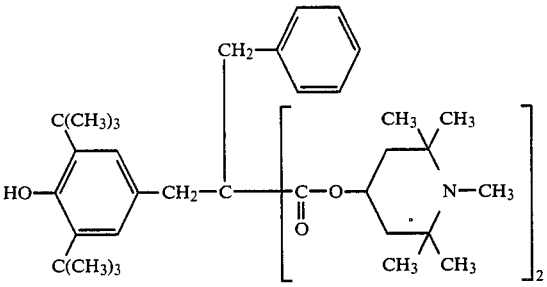
IV-24
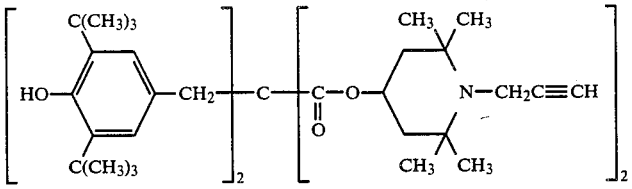
IV-25
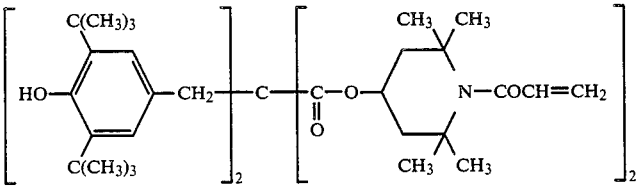

-continued
IV-26
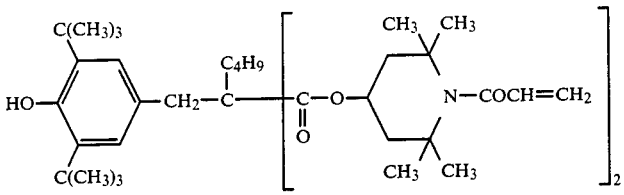
IV-27
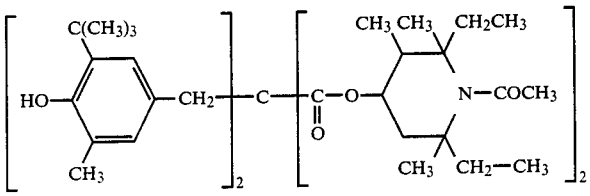
IV-28
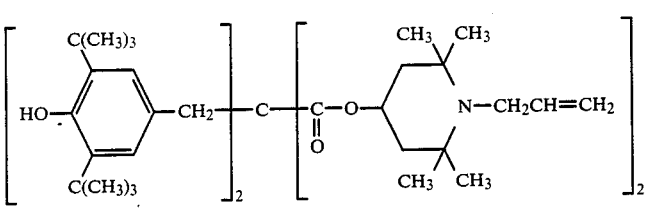
The following are examples of the compounds having Formula [V], but the present invention is not limited by the examples.
V-1
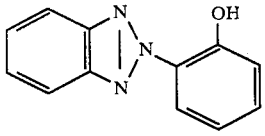
V-2
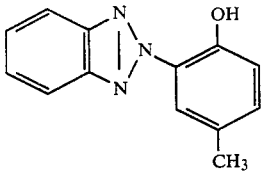
V-3
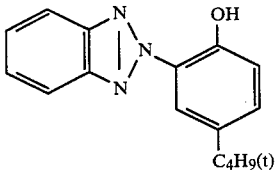
V-4
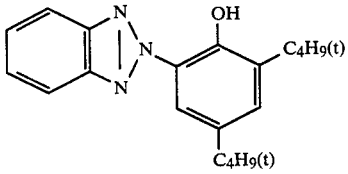
V-5
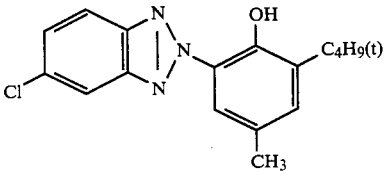
-continued
V-6
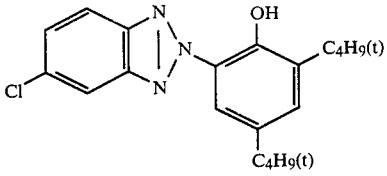
V-7
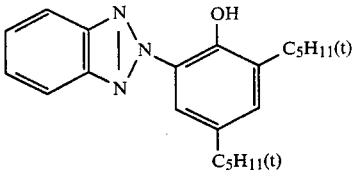
V-8
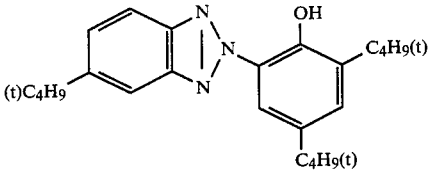
V-9
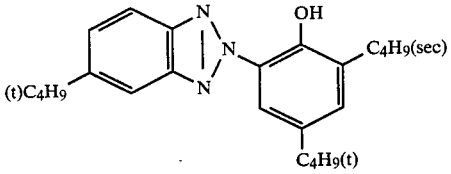
V-10
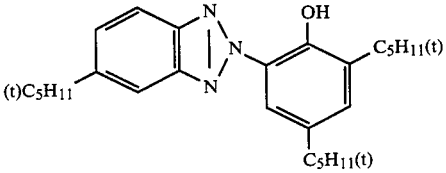

-continued

V-11

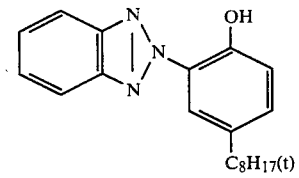

V-12

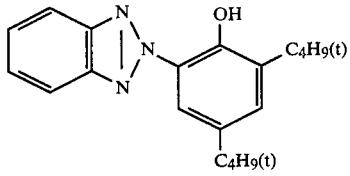

V-13

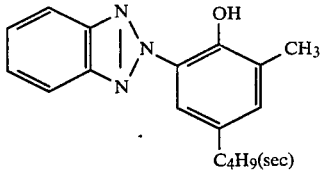

V-14

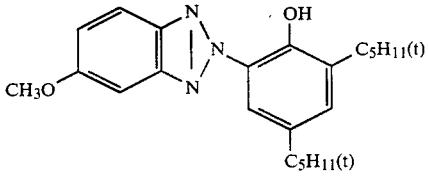

V-15

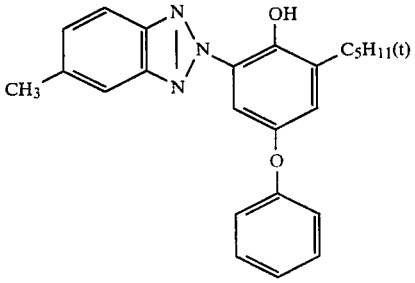

V-16

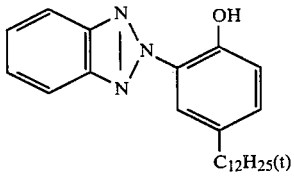

V-17

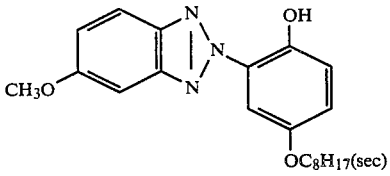

In incorporating the compounds of this invention having Formulas [III], [IV] and [V] into a silver halide emulsion layer, the using quantity thereof is desirable to be from 5 to 200 parts by weight, and more preferably from 10 to 100 parts by weight, to 100 parts by weight of the cyan couplers having Formulas [I] and [II].

The silver halide photographic light-sensitive material of this invention is allowed to be any one as long as it is so constructed that at least one silver halide emulsion layer is provided on a support, and no particular restrictions are put on the number of and the other of silver halide emulsion layers and non-light-sensitive layers. Typical examples of such silver halide light-sensitive materials include positive and negative color films, color photographic papers, color slides, those for special uses, such as graphic arts films, X-ray films, high-resolution films or plates, and the like. The silver halide light-sensitive material of this invention is particularly suitable for color photographic papers. Normally, the foregoing silver halide emulsion layers and non-light-sensitive layers are mostly hydrophilic binder-containing hydrophilic colloidal layers. As the hydrophilic binder gelatin or gelatin derivatives such as acylated gelatin, guanidylated gelatin, carbamylated gelatin, cyanoethanolated gelatin, esterified gelatin, and the like, are suitably usable.

The cyan couplers of this invention having Formulas [I] and [II] (hereinafter referred to as the cyan couplers of this invention) may be incorporated, in similar manner to that for ordinary cyan dye forming couplers, into silver halide emulsion layers to be coated on a support to thereby form a photographic element. The photographic element may be either a monochromatic element or a multicolor element. In the case of a multicolor element, the cyan couplers of this invention are normally incorporated into a red-sensitive silver halide emulsion layer, but may be incorporated into a non-sensitized emulsion layer or into an emulsion layer sensitive to non-red spectral three-primary-color regions. Each component unit for the dye image formation is either a single emulsion layer or multilayered emulsion layer unit.

The incorporation of the cyan couplers of this invention may be carried out in accordance with conventionally known methods. For example, the cyan couplers of this invention are either singly or mixedly dissolved into a single high-boiling organic solvent such as a phthalate (e.g., dibutyl phthalate), phosphate (e.g., tricresyl phosphate) or N,N-dialkyl-substituted amide (e.g., N,N-diethyl-laurylamide) and a single low-boiling organic solvent such as butyl acetate or butyl propionate, or, if necessary, into a mixture of these high- and low-organic solvents. After that, the solution is mixed with an aqueous gelatin solution containing a surface active agent, the mixture is then emulsifiedly dispersed by means of a high-speed rotary mixer, colloid mill, ultrasonic dispenser, or the like, and the dispersed liquid is then added to a silver halide, thus preparing a silver halide emulsion to be used in this invention.

The cyan couplers of this invention, when added to a silver halide emulsion layer, are used in the quantity range of from about 0.05 to 2 moles, and preferably from 0.1 to 1 mole per mole of silver halide.

In the case where the silver halide photographic light-sensitive material of this invention is a multicolor element, the layers required for the photographic element including the above image forming component units may be arranged in various orders as well-known to those skilled in the art. A typical multicolor photographic element comprises a support having thereon a cyan dye forming component unit comprised of at least one red-sensitive silver halide emulsion layer containing cyan dye forming couplers (at least one of cyan dye forming couplers is the cyan coupler of this invention having Formula [I], and further at least one is the cyan coupler of this invention having Formula [II]); a magenta dye forming component unit comprised of at least one green-sensitive silver halide emulsion layer containing at least one magenta dye forming coupler; and an yellow dye forming component unit comprised of at least one blue-sensitive silver halide emulsion layer containing at least one yellow dye forming coupler.

The photographic element may have additional layers: non-light-sensitive layers such as filter layers, interlayers, a protective layer, an antihalation layer, a subbing layer, and the like.

Suitably usable as the yellow dye forming coupler in the present invention are those compounds having the following Formula [X]:

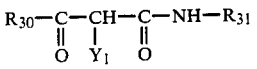

Formula [X]

wherein $R_{30}$ is an alkyl group (such as methyl, ethyl, propyl, butyl, etc.) or an aryl group (such as phenyl, P-methoxyphenyl, etc.); $R_{31}$ is an aryl group; and $Y_1$ is a hydrogen atom or a group that can be split off during the color developing reaction.

Further, the particularly preferred ones as the yellow coupler for used in the dye image formation in this invention are those compounds having the following Formula [X']:

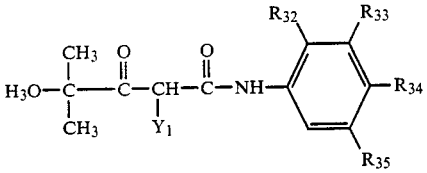

Formula [X']

wherein $R_{32}$ is a halogen atom, an alkoxy or aryloxy group; $R_{33}$, $R_{34}$ and $R_{35}$ each is a hydrogen atom, a halogen atom, an alkyl, alkenyl, alkoxy, aryl, aryloxy, carbonyl, sulfonyl, carboxyl, alkoxycarbonyl, carbamyl, sulfone, sulfamyl, sulfonamido, acylamido, ureido or amino group; and $Y_1$ is as defined previously.

These are described in, e.g., U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072 and 3,894,875; West German OLS Pat. Nos. 1,547,868, 2,057,941, 2,162,899, 2,163,812, 2,213,461, 2,219,917, 2,261,361, and 2,263,875; Japanese Patent Examined Publication No. 13576/1974; and Japanese Patent O.P.I. Publication Nos. 29432/1973, 66834/1973, 10736/1974, 122335/1974, 28834/1975 and 132926/1975.

Suitably usable as the magenta dye image forming coupler are those couplers having the following Formula [XI]:

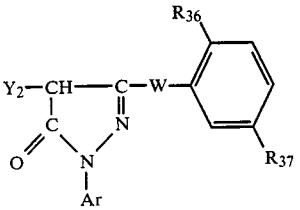

Formula [XI]

wherein Ar is an aryl group; $R_{36}$ is a hydrogen atom, a halogen atom, an alkyl or alkoxy group; $R_{37}$ is an alkyl, amido, imido, N-alkylcarbamoyl, N-alkylsulfamoyl, alkoxycarbonyl, acyloxy, sulfonamido or urethan group; $Y_2$ is as defined in Formula [X]; and W represents —NH—, —NHCO— (wherein the N atom is bonded with the carbon atom of the pyrazolone nucleus) or —NHCONH—.

These are described in, e.g., U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500; Japanese Patent O.P.I. Publication Nos. 29639/1974, 111631/1974, 129538/1974, 13041/1975, 58922/1977, 62454/1980, 118034/1980 and 38043/1981; British Patent No. 1,247,493; Belgian Patent Nos. 769,116 and 792,525; West German Pat. No. 2,156,111; and Japanese Patent Examined Publication No. 60479/1971.

The following are typical examples of the yellow and magenta couplers suitably usable in this invention, but those usable in the invention are not limited thereto.

Yellow couplers:

(Y-1) α-benzoyl-2-chloro-5-[α-(dodecyloxycarbonyl)-ethoxycarbonyl]-acetanilide (Y-2) α-benzoyl-2-chloro-5-[γ-(2,4-di-t-amylphenoxy)-butylamido]-acetanilide (Y-3) α-fluoro-α-pivalyl-2-chloro-5-[γ-(2,4-di-t-amylphenoxy)-butylamido]-acetanilide (Y-4) α-pivalyl-α-stearoyloxy-4-sulfamoyl-acetanilide (Y-5) α-pivalyl-α-[4-(4-benzyloxyphenylsulfonyl)-phenoxy]-2-chloro-5-[γ-(2,4-di-t-amylphenoxy)-butylamido]-acetanilide (Y-6) α-(2-methoxybenzoyl)-α-(4-acetophenoxy)-4-chloro-2-(4-t-octylphenoxy)-acetanilide (Y-7) α-pivalyl-α-(3,3-dipropyl-2,4-dioxo-acetidin-1-yl)-2-chloro-5-[α-(dodecyloxycarbonyl)-ethoxycarbonyl]-acetanilide (Y-8) α-pivalyl-α-succinimido-2-chloro-5-[γ-(2,4-di-t-amylphenoxy)butylamido]-acetanilide (Y-9) α-pivalyl-α-(3-tetradecyl-1-succinimido)-acetanilide (Y-10) Dipotassium α-(4-dodecyloxybenzoyl)-α-(3-methoxy-1-succinimido)-3,5-dicarboxyacetanilide.

(Y-11) α-pivalyl-α-phthalimido-2-chloro-5-[γ-(2,4-di-t-amylphenoxy)butylamido]-acetanilide (Y-12) α-2-furyl-α-phthalimido-2-chloro-5-[γ-(2,4-di-t-amylphenoxy)butylamido]-acetanilide (Y-13) α-3-[α-(2,4-di-t-amylphenoxy)butylamido]-benzoyl-α-succinimido-2-methoxyacetanilide (Y-14) α-phthalimido-α-pivalyl-2-methoxy-4-[(N-methyl-N-octadecyl-sulfamoyl]-acetanilide (Y-15) α-acetyl-α-succinimido-2-methoxy-4-[(N-methyl-N-octadecyl)sulfamoyl]-acetanilide (Y-16) α-cyclobutyryl-α-(3-methyl-3-ethyl-1-succinimido)-2-chloro-5-[(2,5-di-t-amylphenoxy)acetamido]-acetanilide (Y-17) α-(3-octadecyl-1-succinimido)-α-propenoyl-acetanilide (Y-18) α-(2,6-di-oxo-3-n-propyl-piperidine-1-yl)-α-pivalyl-2-chloro-5-[γ-(2,4-di-t-amylphenoxy)butylcarbamoyl]-acetanilide (Y-19) α-(1-benzyl-2,4-dioxo-imidazolidine-3-yl)-α-pivalyl-2-chloro-5-[γ-(2,4-di-t-amylphenoxy)-butylamido]-acetanilide (Y-20) α-(1-benzyl-2-phenyl-3,5-dioxo-1,2,4-triazine-4-yl)-α-pivalyl-2-chloro-5-[γ-(2,4-di-t-amylphenoxy)-butylamido]-acetanilide (Y-21) α-(3,3-dimethyl-1-succinimido)-α-pivalyl-2-chloro-5-[γ-(2,4-di-t-amylphenoxy)butylamido]-acetanilide (Y-22) α-[3-(p-chlorophenyl)-4,4-dimethyl-2,5-dioxo-1-imidazol-yl]-α-pivalyl-2-chloro-5-[γ-(2,4-di-t-amiyl-phenoxy)-butylamido]-acetanilide (Y-23) α-pivalyl-α-(2,5-dioxo-1,3,4-triazine-1-yl)-2-methoxy-5-[α-(2,4-di-t-amylphenoxy)-butylamino]-acetanilide (Y-24) α-(5-benzyl-2,4-dioxo-3-oxazoyl)-α-pivalyl-2-chloro-5-[γ-(2,4-di-t-amylphenoxy)-butylamido]-acetanilide (Y-25) α-(5,5-dimethyl-2,4-dioxo-3-oxazoyl)-α-pivalyl-2-chloro-5-[α-(2,4-di-t-amylphenoxy)-butylamido]-acetanilide (Y-26) α-(3,5-dioxo-4-oxazinyl)-α-pivalyl-2-chloro-5-[γ-(2,4-di-t-amylphenoxy)-butylamido]-acetanilide (Y-27) α-pivalyl-α-(2,4-dioxo-5-methyl-3-thiazolyl)-2-chloro-5-[γ-(2,4-di-t-amylphenoxy)-butylamido]-acetanilide (Y-28) α-[3(2H)-pyridazone-2-yl]-α-pivalyl-2-chloro-5-[γ-(2,4-di-t-amylphenoxy)-butylamido]-acetanilide (Y-29) α-[4,5-dichloro-3(2H)-pyridazone-2-yl]-α-benzoyl-2-chloro-5-[α-(dodecyloxycarbonyl)-ethoxycarbonyl]-acetanilide (Y-30) α-(1-phenyl-tetrazol-t-oxy)-α-pivalyl-2-chloro-5-[γ-(2,4-di-t-amylphenoxy)-butylamido]-acetanilide (Y-31) 4,4-di-(acetacetamino)-3,3-dimethyldiphenylethane (Y-32) P,P'-di-(acetacetamino)-diphenylmethane Magenta couplers:

(M-1) 1-(2,4,6-trichlorophenyl)-3-(2-chloro-5-octadecylcarbamoyl-anilino)-5-pyrazolone (M-2) 1-(2,4,6-trichlorophenyl)-3-(2-chloro-5-tetradecanamido-anilino)-5-pyrazolone (M-3) 1-(2,4,6-trichlorophenyl)-3-[2-chloro-5-γ-(2,4-di-t-amylphenoxy)-butylcarbamoyl]-anilino-5-pyrazolone (M-4) 1-(2,4,6-trichlorophenyl)-4-chloro-3-[2-chloro-5-γ-(2,4-di-t-amylphenoxy)-butylcarbamoyl]-anilino-5-pyrazolone (M-5) 1-(2,4,6-trichlorophenyl)-4-diphenylmethyl-3-[2-chloro-5-(γ-octadecenylsuccinimido)-propylsulfamoyl]-anilino-5-pyrazolone (M-6) 1-(2,4,6-trichlorophenyl)-4-acetoxy-5-(2-chloro-5-tetradecanamido)-anilino-5-pyrazolone (M-7) 1-[γ-(3-pentadecylphenoxy)-butylamido]-phenyl-3-anilino-4-(1-phenyl-tetrazol-5-thio)-5-pyrazolone (M-8) 1-(2,4,6-trichlorophenyl)-3-(2-chloro-5-octadecylsuccinimido)-anilino-5-pyrazolone (M-9) 1-(2,4,6-trichlorophenyl)-3-(2-chloro-5-octadecenylsuccinimido)-anilino-5-pyrazolone (M-10) 1-(2,4,6-trichlorophenyl)-3-[2-chloro-5-(N-phenyl-N-octylcarbamoyl)]-anilino-5-pyrazolone (M-11) 1-(2,4,6-trichlorophenyl)-3-[2-chloro-5-(N-butylcarbonyl)pyradinylcarbonyl]-anilino-5-pyrazolone (M-12) 1-(2,4,6-trichlorophenyl)-3-[2-chloro-5-(2,4-dicarboxy-5-phenylcarbamoyl)-benzylamido]-anilino-5-pyrazolone (M-13) 1-(2,4,6-trichlorophenyl)-3-(4-tetradecylthiomethylsuccinimido)-anilino-5-pyrazolone (M-14) 1-(2,4,6-trichlorophenyl)-3-[2-chloro-4-(2-benzofurylcarboxyamido)]-anilino-5-pyrazolone (M-15) 1-(2,4,6-trichlorophenyl)-3-{2-chloro-4-[γ-(2,2-dimethyl-6-octadecyl-7-hydroxy-chroman-4-yl)-propionamido]}-anilino-5-pyrazolone (M-16) 1-(2,4,6-trichlorophenyl)-3-[2-chloro-5-(3-pentadecylphenyl)-phenylcarbonylamido]-anilino-5-pyrazolone (M-17) 1-(2,4,6-trichlorophenyl)-3-{2-chloro-5-[2-(3-t-butyl-4-hydroxyphenoxy)-tetradecanamido]-anilino}-5-pyrazolone (M-18) 1-(2,6-dichloro-4-methoxyphenyl)-3-(2-methyl-5-tetradecanamido)-anilino-5-pyrazolone (M-19) 4,4'-benzylidene-bis-[1-(2,4,6-trichlorophenyl)-3-{2-chloro-4-[γ-(2,4-di-t-amylphenoxy)-butylamido]-anilino}-5-pyrazolone]

(M-20) 4,4'-benzylidene-bis-[1-(2,3,4,5,6-pentachlorophenyl)-3-2-chloro-5-[γ-(2,4-di-t-amylphenoxy)-butylamido]-anilino-5-pyrazolone]

(M-21) 4,4'-(2-chloro)benzylidene-bis[1-(2,4,6-trichlorophenyl)-3-(2-chloro-5-dodecylsuccinimido)-anilino-5-pyrazolone]

(M-22) 4,4'-benzylidene-bis[1-(2-chlorophenyl)-3-(2-methoxy-4-hexadecanamido)-anilino-5-pyrazolone]

(M-23) 4,4'-methylene-bis[1-(2,4,6-trichlorophenyl)-3-(2-chloro-5-dodecenylsuccinimido)-anilino-5-pyrazolone]

(M-24) 1-(2,4,6-trichlorophenyl)-3-[3-(2,4-di-t-amylphenoxyacetamido)benzamido]-5-pyrazolone (M-25) 3-ethoxy-1-4-[α-(3-pentadecylphenoxy)-butylamido]phenyl-5-pyrazolone (M-26) 1-(2,4,6-trichlorophenyl)-3-[2-chloro-5-{α-(3-t-butyl-4-hydroxy)-phenyl}-tetradecanamido]-anilino-5-pyrazolone (M-27) 1-(2,4,6-trichlorophenyl)-3-3-nitroanilino-5-pyrazolone Any of these yellow dye forming couplers and magenta dye forming couplers may be incorporated in a quantity of from 0.05 to 2 moles per mole of silver halide into a silver halide emulsion layer.

Materials usable as the support of the silver halide photographic light-sensitive material of this invention include, e.g., baryta paper, polyethylene-coated paper, polypropylene synthetic paper, reflective layer or material-provided transparent support, glass plates, polyester films such as of cellulose acetate, cellulose nitrate, polyethylene terephthalate, etc., polyamide film, polycarbonate film, polystyrene film, and the like. These support materials may be arbitrarily selected according to the purpose for which the silver halide light-sensitive material of this invention is used.

The coating of the silver halide emulsion layers and non-light-sensitive layers to be used in this invention may be carried out by various coating methods such as the dipping coating method, air doctor coating method, curtain coating method, hopper coating method, and the like.

The silver halide used in the silver halide emulsion of this invention includes those used generally in ordinary silver halide emulsions, such as silver bromide, silver chloride, silver iodobromide, silver chlorobromide, silver chloroiodobromide, and the like. These silver halides may be either coarse-grained or fine-grained. Their grain size distribution may be either wider or narrower. Their grain crystal may be either regular or twin, and those whose crystal is of an arbitrary [100] face-[111] face proportion may be used. Further, the crystal of these silver halide grains may be of either homogeneous structure from the inside through the outside or heterogeneous structure stratified with the inside and the outside. In addition, these silver halides may be of either the type of forming a latent image mainly on the grain surface or the type of forming a latent image inside the grain. Further, these silver halides may be prepared in any of the manners such as the neutral method, ammoniacal method, acidic method, and the like, and also may be ones manufactured by the simultaneous mixing process, sequentially mixing process, reversely mixing process, conversion process, and the like.

The silver halide emulsion of this invention may be chemically sensitized by the single use or arbitrarily combined use of chemical sensitizers including sulfur sensitizers such as, e.g., arylthiocarbamides, thiourea, cystine, etc.; active or inert selenium sensitizers; reduction sensitizers such as, e.g., stannous salts, polyamines, etc.; noble-metallic sensitizers including gold sensitizers such as potassium aurithiocyanate, potassium chloroaurate, 2-aurosulfobenzothiazolemethyl chloride, etc., water-soluble-salt sensitizers of ruthenium, rhodium, iridium, etc., such as ammonium chloropalladate, potassium chloroplatinate, sodium chloropalladite; and the like.

The silver halide emulsion of this invention may contain various prior-art photographic additives such as those described in, e.g., Research Disclosure No. 17643, Dec. 1978.

The silver halide of this invention, to be rendered sensitive to the wavelength region required for a red-sensitive emulsion, is spectrally sensitized by an appropriately selected sensitizing dye. There are various spectrally sensitizing dyes for this purpose, which may be used alone or in combination.

Those advantageously usable in this invention are typified by the cyanine dyes, merocyanine dyes, and complex cyanine dyes disclosed in, e.g., U.S. Pat. Nos. 2,269,234, 2,270,378, 2,442,710, 2,454,620, and 2,776,280.

The silver halide emulsion layers and non-light-sensitive layers of the silver halide photographic light-sensitive material of this invention may contain various other photographic additives such as the antifogant, antistain agent, brightening agent, antistatic agent, hardening agent, plasticizer, wetting agent, ultraviolet absorbing agent, and the like, disclosed in Research Disclosure No.17643.

The thus constructed silver halide color photographic light-sensitive material of this invention is exposed imagewise and then color-developed in any of various processing manners. The preferred color developer liquid used in this invention contains an aromatic primary amine-type color developing agent as the principal component thereof. Typical examples of the color developing agent are of the p-phenylenediamine type, which include, e.g., diethyl-p-phenylenediamine hydrochloride, monomethyl-p-phenylenediamine hydrochloride, dimethyl-phenylenediamine hydrochloride, 2-amino-5-(N-ethyl-N-dodecylamino)toluene, 2-amino-5-(N-ethyl-N-$\beta$-methanesulfonamidoethyl)aminotoluene sulfate, 4-(N-ethyl-N-$\beta$-methanesulfonamidoethylamino)aniline, 4-(N-ethyl-N-$\beta$-hydroxyethylamino)-aniline, 2-amino-5-(N-ethyl-$\beta$-methoxyethyl)-aminotoluene, and the like. These color developing agents may be used alone or in combination, and, if necessary, in combination with a black-and-white developing agent such as hydroquinone. Further, the color developer liquid generally contains an alkaline agent such as, e.g., sodium hydroxide, ammonium hydroxide, sodium carbonate, sodium sulfite, or the like, and in addition various other additives, for example, halogenated alkaline metal such as potassium bromide; a development control agent such as hydrazinic acid, etc.; and the like.

The silver halide photographic light-sensitive material of this invention may contain in the hydrophilic colloidal layer thereof the foregoing color developing agent as the color developing agent as it is or in the form of the precursor thereof. The color developing agent precursor is a compound capable of forming a color developing agent under an alkaline condition, the color developing agent precursor including the Schiff's base-type precursor with an aromatic aldehyde derivative, polyvalent-metallic ion complex precursor, phthalic acid imide-derivative precursor, sugar-amine-reactant precursor, and urethane-type precursor. These aromatic primary amine color developing agent precursors are described in, e.g., U.S. Pat. Nos.3,342,599, 2,507,114, 2,695,234 and 3,719,492; British Pat. No.803,783; Japanese Patent O.P.I. Publication Nos.135628/1978 and 79035/1979; and Research Disclosure Nos. 15,159, 12,146 and 13,924.

These aromatic parimary amine color developing agents or the precursors thereof are required to be added in such a quantity that a sufficient color density can be obtained in the developing process. The quantity differs largely according to the kind, etc., of the light-sensitive material used, but is in the range of from approximately 0.1 mole to 5 moles per mole of light-sensitive silver halide, and preferably from 0.5 mole to 3 moles. These color developing agents or the precursors thereof may be used alone or in combination. The incorporation of any of these compounds into the photographic light-sensitive material of this invention may be carried out through the addition of a solution prepared by dissolving the compound into an appropriate solvent such as water, methanol, ethanol, acetone, or the like; or through the addition of an emulsifiedly dispersed liquid prepared by dispersing the compound into a high-boiling solvent such as dibutyl phthalate, dioctyl phthalate, tricresyl phosphate, or the like; or also through the addition of the compound in the form of being impregnated into a latex polymer, as disclosed in Research Disclosure No.14850.

The silver halide photographic light-sensitive material of this invention, after the color development thereof, is usually bleached and then fixed, or bleach-fixed and then washed. The bleaching agent usable includes a number of compounds, among which polyvalent metallic compounds such as of iron (III), cobalt (III), tin (II), etc.; particularly complex salts of these polyvalent-metallic cations with organic acids, such as metallic complex salts of aminopolycarboxylic acids such as ethylenediaminetetraacetic acid, nitrilotriacetic acid, N-hydroxyethylethylenediaminediacetic acid, etc., malonic acid, tartaric acid, malic acid, diglycolic acid, dithioglycolic acid, and the like, or ferricyanates, bichromates, and the like, may be used alone or in combination.

According to the silver halide photographic light-sensitive material of this invention, the cyan couplers of this invention contained in the silver halide emulsion layer is satisfactory in the solubility, dispersibility and dispersing stability, bringing about no coupler deposition trouble. These cyan couplers are excellent in the spectral absorbability as well as in the resulting color tone, and capable of forming a clear dye image over a wide color reproduction range. Particularly, the cyan couplers form a cyan dye image having the maximum absorption wavelength in 640 to 660 nm and having very little absorption in the wavelength ranges of from 400 to 450 nm, from 450 to 480 nm, and from 500 to 550 nm, thus providing an image with very satisfactory lightness without deterioration of the blue and green color reproductions. And the formed dye image is excellent in the image preservability with the resistances against light, heat and moisture, producing very little Y-stain, during its storage over a long period of time.

The following examples further illustrate the present invention. The invention is not limited by the examples.

EXAMPLE 1

The cyan couplers of this invention given in Table 1 and the following comparative coupler-1 were used. Ten grams of each coupler and 3 g of each of the compounds [III], [IV] and [V] or A were added to a mixture of 5 ml of dibutyl phthalate with 30 ml of ethyl acetate and then the mixture was completely dissolved by heating to 60° C. The solution was mixed with 5 ml of an aqueous 10% Alkanol XC (sodium alkylnaphthalenesulfonate, a product of DuPont) solution and 200 ml of an aqueous 5% gelatin solution. The mixture liquid was then emulsified by means of a colloid mill to thereby prepare their respective coupler-dispersed liquids. Next, these dispersed liquids each was added to 500 g of a silver chloride (containing 80 mole% silver bromide) emulsion, and the prepared emulsion was coated on a polyethylene-coated paper support and then dried, whereby 13 different monochromatic photographic elements No.1 to 31 were prepared. These samples each was exposed through an optical wedge in usual manner, and then processed in the following procedure:

| Processing steps | Temperature | Processing time |
|---|---|---|
| Color development | 30° C. | 3 minutes & 30 seconds |
| Bleach-fix | 30° C. | 1 minute & 30 seconds |
| Washing | 30° C. | 2 minutes |

The compositions of the processing liquids are as follows:

Color developer:

| | |
|---|---|
| 4-amino-3-methyl-N—ethyl-N—(β-methanesulfonamidoethyl)-aniline sulfate | 5 g |
| Benzyl alcohol | 15 ml |
| Sodium hexametaphosphate | 2.5 g |
| Anhydrous sodium sulfite | 1.85 g |
| Sodium bromide | 1.4 g |
| Potassium bromide | 0.5 g |
| Borax | 39.1 g |
| Water to make 1 liter. Use sodium hydroxide to adjust the pH to 10.3 | |

Bleach-fix bath:

| | |
|---|---|
| Iron-ammonium ethylenediaminetetraacetate | 61.0 g |
| Diammonium ethylenediaminetetraacetate | 5.0 g |
| Ammonium thiosulfate | 124.5 g |
| Sodium metabisulfite | 13.5 g |
| Anhydrous sodium sulfite | 2.7 g |
| Water to make 1 liter | |

Each of the samples obtained after the processing was tested with respect to the spectral reflection characeristics and image preservability in the following manners.

Spectral reflection characteristics test:

(i) Reflection maximum wavelength (λmax): A PDA-60 densitometer (manufactured by Konishiroku Photo Industry Co., Ltd.) was used to measure the wavelength at which the reflection density becomes maximum.

(ii) Reflection density(D): The same densitometer as in (i) was used to measure the reflection densities at the wavelengths λ=550, 470 and 420(nm) when the maximum reflection density is equal to 2.0.

(iii) Lightness (L*): Measurement was made in accordance with the procedure specified in JIS Z 8729-1980.

Image preservability test:

(iv) Resistivity to light: A xenon fadeometer was used to expose each dye image to its light of 45,000 luxes over periods of 150 hours (for one half of the image) and 450 hours (for the other half), and after that, the residual densities of the areas where the initial density was 1.0 were measured.

(v) Y-stain caused by light: The white background of each sample was exposed to the light of 45,000 luxes of the same xenon fadeometer in like manner as in (iv) over periods of 150 hours and 450 hours, and the degrees of the background's discoloration into yellow were measured in terms of blue densities $D_B$ to thereby find the respective yellow-discoloration rates.

(vi) Dark discoloration: Each dye image was allowed to stand in the dark at 77° C. over periods of two weeks and 4 weeks, and then the residual densities of the area where the initial density was 1.0 were measured.

The results obtained in the above tests (i) through (vi) are as given in Table 1.

Comparative Coupler-1

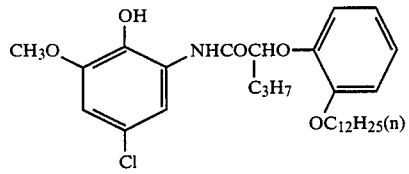

Dye Image Stabilizer A

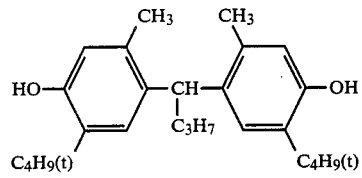

TABLE 1

| Sample No. | Cyan coupler composition: Exemplified cyan coupler having Formula [I] and mole % | Exemplified cyan coupler having Formula [II] and mole % | comparative cyan coupler and mole % | Dye image stabilizer | Discoloration in the light 150 hrs | Discoloration in the light 450 hrs | Y-stain caused by light 150 hrs | Y-stain caused by light 450 hrs |
|---|---|---|---|---|---|---|---|---|
| 1 | I-5, 100 | — | — | — | 0.79 | 0.38 | 130 | 170 |
| 2 | " | — | — | III-34 | 0.80 | 0.43 | 129 | 162 |

TABLE 1-continued

| | | | | | | | | |
|---|---|---|---|---|---|---|---|---|
| 3 | " | — | — | IV-25 | 0.81 | 0.43 | 129 | 160 |
| 4 | " | — | — | V-7 | 0.80 | 0.42 | 130 | 162 |
| 5 | " | — | — | A | 0.79 | 0.41 | 129 | 169 |
| 6 | I-5, 70 | II-3, 30 | — | — | 0.87 | 0.40 | 129 | 165 |
| 7 | " | " | — | III-34 | 0.89 | 0.77 | 114 | 134 |
| 8 | " | " | — | IV-25 | 0.89 | 0.76 | 114 | 130 |
| 9 | " | " | — | V-7 | 0.90 | 0.77 | 115 | 138 |
| 10 | " | " | — | A | 0.98 | 0.41 | 125 | 161 |
| 11 | I-36, 80 | II-1, 20 | — | — | 0.77 | 0.34 | 127 | 169 |
| 12 | " | " | — | III-34 | 0.81 | 0.72 | 115 | 137 |
| 13 | " | " | — | IV-25 | 0.80 | 0.70 | 116 | 138 |
| 14 | " | " | — | V-7 | 0.80 | 0.70 | 113 | 135 |
| 15 | " | " | — | A | 0.79 | 0.35 | 125 | 160 |
| 16 | I-4, 60 | II-3, 40 | — | — | 0.84 | 0.41 | 127 | 164 |
| 17 | " | " | — | III-34 | 0.85 | 0.76 | 116 | 131 |
| 18 | " | " | — | IV-25 | 0.85 | 0.76 | 112 | 131 |
| 19 | " | " | — | V-7 | 0.87 | 0.78 | 114 | 135 |
| 20 | " | " | — | A | 0.85 | 0.42 | 121 | 160 |
| 21 | — | II-3, 100 | — | — | 0.91 | 0.55 | 129 | 151 |
| 22 | — | " | — | III-34 | 0.92 | 0.62 | 127 | 140 |
| 23 | — | " | — | IV-25 | 0.92 | 0.62 | 128 | 144 |
| 24 | — | " | — | V-7 | 0.92 | 0.67 | 126 | 142 |
| 25 | — | " | — | A | 0.91 | 0.57 | 126 | 150 |
| 26 | — | — | Comp-1, 100 | — | 0.71 | 0.31 | 131 | 178 |
| 27 | I-4, 60 | — | Comp-1, 40 | — | 0.72 | 0.35 | 127 | 177 |
| 28 | " | — | " | III-34 | 0.73 | 0.34 | 129 | 163 |
| 29 | " | — | " | IV-25 | 0.72 | 0.34 | 128 | 162 |
| 30 | " | — | " | V-7 | 0.74 | 0.35 | 129 | 164 |
| 31 | " | — | " | A | 0.72 | 0.34 | 130 | 167 |

| Sample No. | Discoloration in the dark 2 weeks | Discoloration in the dark 4 weeks | Spectral reflection characteristics (when reflection maximum density is 2.0) λmax | Dλ550 | Dλ470 | Dλ420 | L* | Remarks |
|---|---|---|---|---|---|---|---|---|
| 1 | 0.98 | 0.97 | 650 | 1.22 | 0.38 | 0.74 | 39.3 | Comparative |
| 2 | 0.99 | 0.97 | 650 | 1.22 | 0.38 | 0.74 | 39.3 | " |
| 3 | 0.99 | 0.98 | 650 | 1.22 | 0.38 | 0.74 | 39.3 | " |
| 4 | 0.98 | 0.97 | 650 | 1.22 | 0.38 | 0.74 | 39.3 | " |
| 5 | 0.99 | 0.97 | 650 | 1.22 | 0.38 | 0.74 | 39.3 | " |
| 6 | 0.97 | 0.88 | 650 | 1.03 | 0.29 | 0.78 | 43.5 | Comparative |
| 7 | 0.98 | 0.97 | 650 | 1.03 | 0.29 | 0.78 | 43.5 | Invention |
| 8 | 0.98 | 0.96 | 650 | 1.03 | 0.29 | 0.78 | 43.5 | " |
| 9 | 0.98 | 0.96 | 650 | 1.03 | 0.29 | 0.78 | 43.5 | " |
| 10 | 0.97 | 0.89 | 650 | 1.03 | 0.29 | 0.78 | 43.5 | Comparative |
| 11 | 0.97 | 0.85 | 655 | 1.02 | 0.31 | 0.80 | 42.0 | " |
| 12 | 0.98 | 0.97 | 655 | 1.02 | 0.31 | 0.80 | 42.0 | Invention |
| 13 | 0.98 | 0.97 | 655 | 1.02 | 0.31 | 0.80 | 42.0 | " |
| 14 | 0.99 | 0.96 | 655 | 1.02 | 0.31 | 0.80 | 42.0 | " |
| 15 | 0.97 | 0.87 | 655 | 1.02 | 0.31 | 0.80 | 42.0 | Comparative |
| 16 | 0.97 | 0.87 | 647 | 1.08 | 0.30 | 0.78 | 42.3 | " |
| 17 | 0.98 | 0.96 | 647 | 1.08 | 0.30 | 0.78 | 42.3 | Invention |
| 18 | 0.99 | 0.97 | 647 | 1.08 | 0.30 | 0.78 | 42.3 | " |
| 19 | 0.98 | 0.97 | 647 | 1.08 | 0.30 | 0.78 | 42.3 | " |
| 20 | 0.97 | 0.88 | 647 | 1.08 | 0.30 | 0.78 | 42.3 | Comparative |
| 21 | 0.64 | 0.43 | 650 | 1.02 | 0.27 | 0.94 | 45.0 | " |
| 22 | 0.71 | 0.47 | 650 | 1.02 | 0.27 | 0.94 | 45.0 | " |
| 23 | 0.70 | 0.49 | 650 | 1.02 | 0.27 | 0.94 | 45.0 | " |
| 24 | 0.78 | 0.58 | 650 | 1.02 | 0.27 | 0.94 | 45.0 | " |
| 25 | 0.64 | 0.44 | 650 | 1.02 | 0.27 | 0.94 | 45.0 | " |
| 26 | 0.63 | 0.41 | 647 | 1.05 | 0.35 | 0.97 | 38.4 | " |
| 27 | 0.87 | 0.79 | 649 | 1.04 | 0.34 | 0.98 | 38.5 | " |
| 28 | 0.89 | 0.81 | 649 | 1.04 | 0.34 | 0.98 | 38.5 | " |
| 29 | 0.89 | 0.81 | 649 | 1.04 | 0.34 | 0.98 | 38.5 | " |
| 30 | 0.89 | 0.85 | 649 | 1.04 | 0.34 | 0.98 | 38.5 | " |
| 31 | 0.87 | 0.80 | 649 | 1.04 | 0.34 | 0.98 | 38.5 | " |

As is apparent from Table 1, any one of the silver halide color photographic light-sensitive material samples of this invention, because of its very little undesirable absorption in the 550 nm and 420 nm and low reflection minimum density, shows the formation of a dye image having a high lightness and satisfactory spectral reflection characteristics as compared to the silver halide color photographic light-sensitive material containing the cyan coupler having Formula [I] alone. This is due to the fact that the combined use of the cyan coupler having Formula [II] enables the samples of this invention to exert a totally unexpected synergistic effect.

And the formed dye image from each of the samples of this invention is very satisfactory in the resistance to light durint its storage over a long period, particularly in the resistance against the Y-stain by light and dark discoloration, thus resulting in the collectively improved image preservability, as compared to the case where the cyan coupler of Formula [I] or [II] is singly used or the case where the cyan couplers of Formulas [I] and [II] are used in combination but no dye image stabilizer is used.

EXAMPLE 2

On a polyethylene-coated paper support the following layers were coated in order from the support side, whereby multicolor photographic element samples were prepared.

Layer 1: An yellow coupler-containing blue-sensitive silver halide emulsion layer (a 90 mole% silver bromide-containing silver chlorobromide emulsion which contains 300 g per mole of silver halide of gelatin and which also contains 0.5 mole per mole of silver halide of the following Yellow Coupler YC-1 dissolved in dibutyl phthalate to be dispersed thereinto) coated and dried so that the coated amount of the gelatin is 2 g/m$^2$.

Layer 2: A first interlayer (a gelatin layer coated so that the amount of gelatin is 1.5 g/m$^2$).

Layer 3: A magenta coupler-containing green-sensitive silver halide emulsion layer (an 80 mole% silver bromide-containing silver chlorobromide solution which contains 400 g per mole of silver halide of gelatin and which also contains 0.3 mole per mole of silver halide of the following Magenta Coupler MC-1 dissolved in dibutyl phthalate to be dispersed thereinto) coated and dried so that the coated amount of the gelatin is 2 g/m$^2$.

Layer 4: An ultraviolet absorbing agent-containing second interlayer (a coating liquid prepared in the manner that the following ultraviolet absorbing agent UV-1 is dissolved into 20 g of dibutyl phthalate to be dispersed into gelatin was coated and dried so that the coated amount of the UV-1 is 0.6 g/m$^2$ and that of the gelatin is 1.5 g/m$^2$).

Layer 5: A cyan coupler-containing red-sensitive silver halide emulsion layer (an 80 mole% silver bromide-containing silver chlorobromide emulsion which contains 300 g per mole of silver halide of gelatin and which also contains 0.4 mole per mole of silver halide of dissolved-in-dibutyl-phthalate-and-dispersed cyan couplers (the exemplified cyan couplers of Formula [I] and of Formula [II]) given in Table 2 and the following Comparative Cyan Coupler-2 (the amount of each cyan coupler is expressed as mole% to the total amount of all the cyan couplers in Table 2), and which further contains the same dye image stabilizer as in Example 1 in a quantity of 35 parts by weight to 100 parts by weight of the cyan couplers) coated and dried so that the coated amount of the gelatin is 20 g/m$^2$.

Layer 6: A protective layer (a gelatin layer coated so that the coated amount of gelatin is 1.5 g/m$^2$).

The thus prepared samples 29 through 42 each was exposed through an optical wedge to blue, green and red lights by use of a sensitometer (Model KS-7, manufactured by Konishiroku Photo Industry Co., Ltd.), and the processed in the following procedure:

| Processing steps (at 32.8° C.) | Processing time |
|---|---|
| Color development | 3 minutes & 30 seconds |
| Bleack-fix | 1 minute & 30 seconds |
| Washing | 3 minutes & 30 seconds |
| Drying | |

Color developer composition:

| | |
|---|---|
| N—ethyl-N—β-methanesulfonamido-ethyl-3-methyl-4-aminoaniline sulfate | 4.0 g |
| Hydroxyamine sulfate | 4.0 g |
| Potassium carbonate | 2.0 g |
| Sodium chloride | 25.0 g |
| Sodium bromide | 0.1 g |
| Benzyl alcohol | 2.0 g |
| Polyethylene glycol (average polymerization degree: 400) | 10.0 ml |
| Water to make 1 liter. Use sodium hydroxide to adjust the pH to 10.0 | 3.0 ml |

Bleach-fix bath composition:

| | |
|---|---|
| Iron-sodium ethylenediaminetetraacetate | 60.0 g |
| Ammonium thiosulfate | 100.0 g |
| Sodium hydrogensulfite | 20.0 g |
| Sodium metabisulfite | 5.0 g |
| Add water to make 1 liter. Use sulfuric acid to adjust the pH to 7.0. | |

YC-1

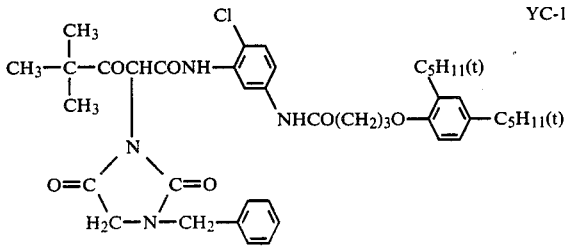

MC-1

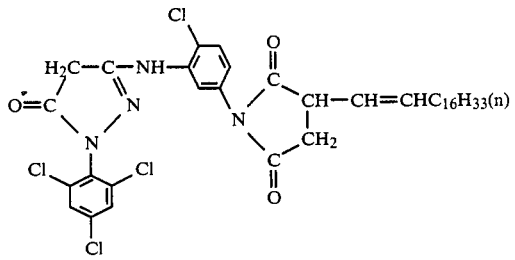

UV-1

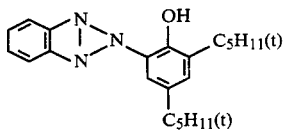

Comparative Cyan Coupler-2

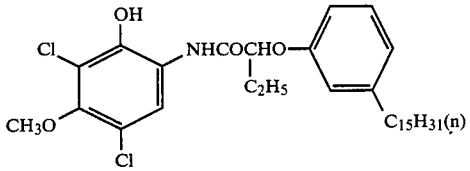

The processed samples each was evaluated with respect to the color recproduction regions and tested with respect to the dye image preservability in the following manners:

Color reproduction region evaluation test:

In accordance with the indication method specified in the color system of L* U* and V* described in Japanese Industrial Standard JIS X 8729-1980, the chromaticity diagram of U' and V' when L*=50 was prepared and the color reproduction regions formed by the yellow, magenta and cyan formed dyes were evaluated according to the relative areas thereof (the overall values in FIG. 3). Further, the color region formed by the cyan color-formed dye and the magenta color-formed dye was regarded as the blue color reproduction region, the color region formed by the cyan color-formed dye and the yellow color-formed dye was regarded as the green color reproduction region, and the color region formed by the magenta color-formed dye and the yellow color-formed dye was regarded as the red color reproduction region, and these color reproduction regions were evaluated according to their relative areas.

Image preservability test:

The yellow (Y), magenta (M) and cyan (C) color-formed dye image was tested in the same manner as in Example 1 with respect to the resistances to light, to Y-stain and to dark discoloration.

The results of these tests are shown in Table 2.

TABLE 2

| Sample No. | Cyan coupler composition: Exemplified cyan coupler having Formula [I] and mole % | Exemplified cyan coupler having Formula [II] and mole % | Comparative cyan coupler and mole % | Dye image stabilizer | Light discoloration 150 hours C | M | Y | 450 hours C | M | Y |
|---|---|---|---|---|---|---|---|---|---|---|
| 32 | I-42, 100 | — | — | — | 0.79 | 0.89 | 0.90 | 0.39 | 0.73 | 0.75 |
| 33 | " | — | — | III-34 | 0.81 | 0.88 | 0.91 | 0.44 | 0.74 | 0.74 |
| 34 | " | — | — | IV-25 | 0.81 | 0.88 | 0.90 | 0.43 | 0.74 | 0.75 |
| 35 | " | — | — | V-7 | 0.80 | 0.88 | 0.91 | 0.42 | 0.73 | 0.74 |
| 36 | " | — | — | A | 0.79 | 0.89 | 0.90 | 0.41 | 0.73 | 0.74 |
| 37 | I-42, 70 | II-3, 30 | — | — | 0.88 | 0.88 | 0.90 | 0.40 | 0.73 | 0.74 |
| 38 | " | " | — | III-34 | 0.90 | 0.89 | 0.90 | 0.77 | 0.76 | 0.75 |
| 39 | " | " | — | IV-25 | 0.89 | 0.88 | 0.90 | 0.77 | 0.75 | 0.75 |
| 40 | " | " | — | V-7 | 0.90 | 0.89 | 0.91 | 0.78 | 0.75 | 0.75 |
| 41 | " | " | — | A | 0.89 | 0.88 | 0.90 | 0.41 | 0.73 | 0.75 |
| 42 | I-37, 70 | II-1, 30 | — | — | 0.77 | 0.88 | 0.90 | 0.35 | 0.72 | 0.76 |
| 43 | " | " | — | III-34 | 0.81 | 0.88 | 0.90 | 0.73 | 0.75 | 0.76 |
| 44 | " | " | — | IV-25 | 0.81 | 0.88 | 0.91 | 0.71 | 0.74 | 0.76 |
| 45 | " | " | — | V-7 | 0.81 | 0.88 | 0.91 | 0.71 | 0.74 | 0.75 |
| 46 | " | " | — | A | 0.79 | 0.88 | 0.90 | 0.35 | 0.73 | 0.76 |
| 47 | I-33, 60 | II-3, 40 | — | — | 0.84 | 0.89 | 0.90 | 0.41 | 0.73 | 0.75 |
| 48 | " | " | — | III-34 | 0.85 | 0.88 | 0.90 | 0.77 | 0.75 | 0.75 |
| 49 | " | " | — | IV-25 | 0.86 | 0.88 | 0.90 | 0.77 | 0.76 | 0.75 |
| 50 | " | " | — | V-7 | 0.87 | 0.88 | 0.90 | 0.78 | 0.76 | 0.76 |
| 51 | " | " | — | A | 0.85 | 0.88 | 0.90 | 0.42 | 0.73 | 0.75 |
| 52 | — | II-3, 100 | — | — | 0.91 | 0.88 | 0.91 | 0.55 | 0.73 | 0.75 |
| 53 | — | " | — | III-34 | 0.91 | 0.89 | 0.91 | 0.62 | 0.74 | 0.75 |
| 54 | — | " | — | IV-25 | 0.92 | 0.89 | 0.90 | 0.64 | 0.74 | 0.76 |
| 55 | — | " | — | V-7 | 0.92 | 0.89 | 0.91 | 0.67 | 0.74 | 0.76 |
| 56 | — | " | — | A | 0.91 | 0.89 | 0.90 | 0.57 | 0.72 | 0.76 |
| 57 | — | — | Comp-2, 100 | — | 0.71 | 0.87 | 0.90 | 0.31 | 0.72 | 0.74 |
| 58 | I-42, 60 | — | Comp-2, 40 | — | 0.73 | 0.88 | 0.90 | 0.36 | 0.73 | 0.75 |
| 59 | " | — | " | III-34 | 0.73 | 0.88 | 0.90 | 0.35 | 0.73 | 0.74 |
| 60 | " | — | " | IV-25 | 0.73 | 0.88 | 0.91 | 0.34 | 0.73 | 0.75 |
| 61 | " | — | " | V-7 | 0.74 | 0.88 | 0.90 | 0.35 | 0.72 | 0.75 |
| 62 | " | — | " | A | 0.72 | 0.87 | 0.90 | 0.34 | 0.72 | 0.75 |

| Sample No. | Light Y-stain (%) 150 hrs | 450 hrs | Dark discoloration 2 weeks C | M | Y | 4 weeks C | M | Y | Color reproduction region Overall | Blue | Green | Red | Remarks |
|---|---|---|---|---|---|---|---|---|---|---|---|---|---|
| 32 | 121 | 144 | 0.98 | 0.96 | 0.98 | 0.97 | 0.96 | 0.98 | 102 | 122 | 84 | 100 | Comparative |
| 33 | 121 | 138 | 0.99 | 0.97 | 0.98 | 0.97 | 0.97 | 0.98 | 102 | 122 | 84 | 100 | " |
| 34 | 120 | 136 | 0.99 | 0.96 | 0.99 | 0.98 | 0.96 | 0.97 | 102 | 122 | 84 | 100 | " |
| 35 | 122 | 138 | 1.00 | 0.96 | 0.98 | 0.98 | 0.96 | 0.97 | 102 | 122 | 84 | 100 | " |
| 36 | 121 | 144 | 0.90 | 0.96 | 0.98 | 0.97 | 0.97 | 0.98 | 102 | 122 | 84 | 100 | " |
| 37 | 121 | 140 | 0.97 | 0.96 | 0.98 | 0.88 | 0.96 | 0.98 | 112 | 121 | 98 | 100 | Comparative |
| 38 | 107 | 114 | 0.98 | 0.97 | 0.97 | 0.97 | 0.97 | 0.98 | 112 | 121 | 98 | 100 | Invention |
| 39 | 107 | 111 | 0.98 | 0.96 | 0.98 | 0.96 | 0.97 | 0.98 | 112 | 121 | 98 | 100 | " |
| 40 | 108 | 117 | 0.98 | 0.96 | 0.98 | 0.96 | 0.96 | 0.98 | 112 | 121 | 98 | 100 | " |
| 41 | 117 | 137 | 0.97 | 0.97 | 0.98 | 0.89 | 0.96 | 0.98 | 112 | 121 | 98 | 100 | |
| | | | | | | | | | | | | Co- | |
| | | | | | | | | | | | | mparative | |
| 42 | 119 | 144 | 0.97 | 0.96 | 0.98 | 0.85 | 0.96 | 0.98 | 109 | 117 | 99 | 100 | Comparative |
| 43 | 108 | 116 | 0.98 | 0.96 | 0.99 | 0.96 | 0.97 | 0.98 | 109 | 117 | 99 | 100 | Invention |
| 44 | 109 | 117 | 0.98 | 0.97 | 0.98 | 0.97 | 0.97 | 0.98 | 109 | 117 | 99 | 100 | " |
| 45 | 105 | 115 | 0.98 | 0.97 | 0.98 | 0.96 | 0.97 | 0.97 | 109 | 117 | 99 | 100 | " |
| 46 | 117 | 136 | 0.98 | 0.96 | 0.98 | 0.88 | 0.97 | 0.98 | 109 | 117 | 99 | 100 | Comparative |
| 47 | 119 | 139 | 0.97 | 0.96 | 0.98 | 0.88 | 0.96 | 0.98 | 111 | 119 | 97 | 100 | " |
| 48 | 109 | 111 | 0.97 | 0.96 | 0.98 | 0.97 | 0.97 | 0.98 | 111 | 119 | 97 | 100 | Invention |
| 49 | 105 | 111 | 0.98 | 0.96 | 0.97 | 0.97 | 0.96 | 0.98 | 111 | 119 | 97 | 100 | " |
| 50 | 108 | 115 | 0.98 | 0.96 | 0.98 | 0.97 | 0.97 | 0.97 | 111 | 119 | 97 | 100 | " |
| 51 | 115 | 136 | 0.98 | 0.97 | 0.98 | 0.88 | 0.97 | 0.98 | 111 | 119 | 97 | 100 | Comparative |
| 52 | 122 | 128 | 0.64 | 0.95 | 0.97 | 0.43 | 0.96 | 0.97 | 100 | 100 | 100 | 100 | Comparative |
| 53 | 121 | 119 | 0.71 | 0.96 | 0.98 | 0.47 | 0.97 | 0.98 | 100 | 100 | 100 | 100 | " |
| 54 | 121 | 122 | 0.72 | 0.96 | 0.98 | 0.49 | 0.97 | 0.98 | 100 | 100 | 100 | 100 | " |
| 55 | 120 | 121 | 0.79 | 0.96 | 0.98 | 0.58 | 0.97 | 0.97 | 100 | 100 | 100 | 100 | " |
| 56 | 120 | 127 | 0.64 | 0.96 | 0.98 | 0.44 | 0.97 | 0.98 | 100 | 100 | 100 | 100 | Comparative |
| 57 | 124 | 151 | 0.63 | 0.96 | 0.97 | 0.41 | 0.96 | 0.98 | 92 | 95 | 91 | 100 | Comparative |

TABLE 2-continued

| | | | | | | | | | | | | | |
|---|---|---|---|---|---|---|---|---|---|---|---|---|---|
| 58 | 121 | 150 | 0.88 | 0.97 | 0.98 | 0.78 | 0.96 | 0.98 | 93 | 97 | 87 | 100 | " |
| 59 | 122 | 138 | 0.89 | 0.96 | 0.98 | 0.81 | 0.96 | 0.97 | 93 | 97 | 87 | 100 | " |
| 60 | 122 | 137 | 0.89 | 0.96 | 0.98 | 0.81 | 0.97 | 0.98 | 93 | 97 | 87 | 100 | " |
| 61 | 122 | 139 | 0.88 | 0.96 | 0.98 | 0.85 | 0.97 | 0.98 | 93 | 97 | 87 | 100 | " |
| 62 | 123 | 142 | 0.87 | 0.96 | 0.98 | 0.80 | 0.96 | 0.98 | 93 | 97 | 87 | 100 | " |

As is apparent from Table 2, in the multicolor photographic element in which the cyan couplers and dye image stabilizer of this invention are used in combination, the green and blue, particularly blue color reproducibility is improved, enabling to form a very clear dye image in a wide color reproduction range. And the photographic element shows a well-balanced discoloration of the cyan, magenta and yellow colors; produces little Y-stain by light; and thus is improved on the overall image preservability.

EXAMPLE 3

Twenty-five different multicolor photographic element samples were prepared in the same manner as in Example 2 except that the exemplified couplers and dye image stabilizers (35 parts by weight to 100 parts by weight of the cyan couplers) given in Table 3 were used in place of those used in Example 2, and (YC-2), (MC-2) and (UV-2) were used in place of the (YC-1), (MC-1) and (UV-1), respectively.

The thus prepared 25 samples each was subjected to the same tests as in Example 2. The results are shown in Table 3.

Comparative dye image stabilizer

B

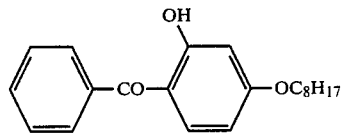

C

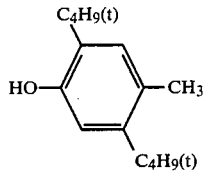

D

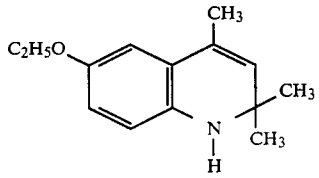

YC-2

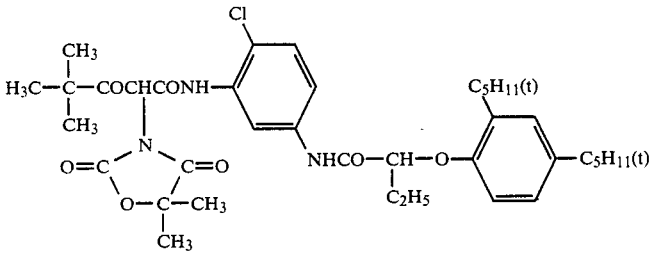

MC-2

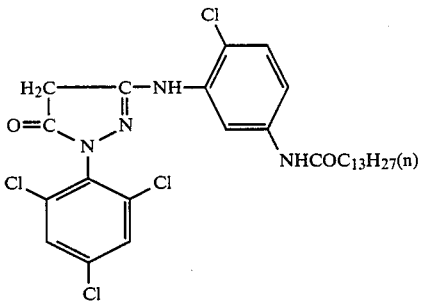

UV-2

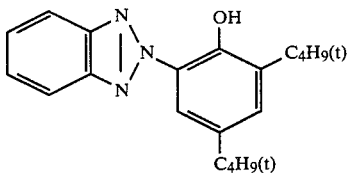

TABLE 3

| Sample No. | Cyan coupler composition: Exemplified cyan coupler having Formula [I] and mole % | Exemplified cyan coupler having Formula [II] and mole % | Comparative cyan coupler and mole % | Dye image stabilizer | Light discoloration 150 hours C | M | Y | 450 hours C | M | Y |
|---|---|---|---|---|---|---|---|---|---|---|
| 63 | I-16, 100 | — | — | — | 0.82 | 0.85 | 0.88 | 0.40 | 0.72 | 0.80 |
| 64 | I-16, 70 | II-4, 30 | — | — | 0.88 | 0.86 | 0.88 | 0.44 | 0.72 | 0.79 |
| 65 | " | " | — | III-21 | 0.89 | 0.86 | 0.88 | 0.76 | 0.74 | 0.79 |
| 66 | " | " | — | IV-14 | 0.90 | 0.86 | 0.89 | 0.76 | 0.74 | 0.80 |
| 67 | " | " | — | V-4 | 0.90 | 0.86 | 0.89 | 0.77 | 0.73 | 0.80 |
| 68 | " | " | — | B | 0.89 | 0.85 | 0.88 | 0.47 | 0.73 | 0.79 |
| 69 | " | " | — | C | 0.89 | 0.85 | 0.88 | 0.48 | 0.72 | 0.79 |

TABLE 3-continued

| | | | | | | | | | | |
|---|---|---|---|---|---|---|---|---|---|---|
| 70 | " | " | — | D | 0.88 | 0.85 | 0.88 | 0.47 | 0.72 | 0.78 |
| 71 | I-32, 70 | II-4, 30 | — | — | 0.73 | 0.84 | 0.88 | 0.35 | 0.73 | 0.78 |
| 72 | " | " | — | — | 0.88 | 0.86 | 0.89 | 0.41 | 0.72 | 0.78 |
| 73 | " | " | — | III-21 | 0.89 | 0.86 | 0.89 | 0.75 | 0.74 | 0.77 |
| 74 | " | " | — | IV-14 | 0.89 | 0.87 | 0.89 | 0.74 | 0.75 | 0.78 |
| 75 | " | " | — | V-4 | 0.89 | 0.86 | 0.89 | 0.74 | 0.75 | 0.77 |
| 76 | " | " | — | B | 0.89 | 0.86 | 0.89 | 0.42 | 0.73 | 0.77 |
| 77 | " | " | — | C | 0.88 | 0.85 | 0.89 | 0.42 | 0.73 | 0.77 |
| 78 | " | " | — | D | 0.89 | 0.86 | 0.88 | 0.41 | 0.72 | 0.78 |
| 79 | — | II-4, 100 | — | — | 0.90 | 0.85 | 0.89 | 0.55 | 0.72 | 0.77 |
| 80 | — | — | Comp-2, 100 | — | 0.77 | 0.85 | 0.88 | 0.31 | 0.72 | 0.78 |
| 81 | I-32, 70 | — | Comp-2, 30 | — | 0.82 | 0.86 | 0.88 | 0.37 | 0.73 | 0.78 |
| 82 | " | — | " | III-21 | 0.84 | 0.86 | 0.88 | 0.39 | 0.74 | 0.78 |
| 83 | " | — | " | IV-14 | 0.83 | 0.86 | 0.89 | 0.38 | 0.74 | 0.77 |
| 84 | " | — | " | V-4 | 0.84 | 0.86 | 0.89 | 0.39 | 0.73 | 0.78 |
| 85 | " | — | " | B | 0.82 | 0.85 | 0.88 | 0.38 | 0.72 | 0.78 |
| 86 | " | — | " | C | 0.82 | 0.85 | 0.88 | 0.37 | 0.73 | 0.77 |
| 87 | " | — | " | D | 0.82 | 0.86 | 0.88 | 0.38 | 0.73 | 0.77 |

| Sample No. | Light Y-stain (%) 150 hrs | 450 hrs | Dark discoloration 2 weeks C | M | Y | 4 weeks C | M | Y | Color reproduction Region Over-all | Blue | Green | Red | Remarks |
|---|---|---|---|---|---|---|---|---|---|---|---|---|---|
| 63 | 132 | 169 | 0.98 | 0.96 | 0.98 | 0.97 | 0.96 | 0.97 | 102 | 121 | 84 | 100 | Comparative |
| 64 | 129 | 164 | 0.97 | 0.96 | 0.97 | 0.88 | 0.96 | 0.97 | 111 | 120 | 98 | 100 | " |
| 65 | 113 | 133 | 0.98 | 0.97 | 0.97 | 0.97 | 0.97 | 0.97 | 111 | 120 | 98 | 100 | Invention |
| 66 | 115 | 131 | 0.98 | 0.96 | 0.97 | 0.98 | 0.96 | 0.97 | 111 | 120 | 98 | 100 | " |
| 67 | 116 | 139 | 0.99 | 0.96 | 0.97 | 0.98 | 0.97 | 0.98 | 111 | 120 | 98 | 100 | " |
| 68 | 125 | 161 | 0.97 | 0.97 | 0.99 | 0.88 | 0.96 | 0.97 | 111 | 120 | 98 | 100 | Comparative |
| 69 | 127 | 159 | 0.97 | 0.96 | 0.97 | 0.88 | 0.96 | 0.97 | 111 | 120 | 98 | 100 | " |
| 70 | 128 | 161 | 0.98 | 0.96 | 0.97 | 0.90 | 0.96 | 0.97 | 111 | 120 | 98 | 100 | " |
| 71 | 129 | 166 | 0.99 | 0.96 | 0.98 | 0.97 | 0.96 | 0.97 | 101 | 118 | 86 | 100 | Comparative |
| 72 | 126 | 161 | 0.96 | 0.97 | 0.98 | 0.82 | 0.96 | 0.97 | 109 | 117 | 99 | 100 | " |
| 73 | 111 | 130 | 0.98 | 0.96 | 0.97 | 0.96 | 0.96 | 0.97 | 109 | 117 | 99 | 100 | Invention |
| 74 | 113 | 129 | 0.98 | 0.96 | 0.97 | 0.96 | 0.97 | 0.97 | 109 | 117 | 99 | 100 | " |
| 75 | 114 | 136 | 0.98 | 0.97 | 0.97 | 0.96 | 0.95 | 0.96 | 109 | 117 | 99 | 100 | " |
| 76 | 124 | 157 | 0.96 | 0.96 | 0.98 | 0.85 | 0.95 | 0.97 | 109 | 117 | 99 | 100 | Comparative |
| 77 | 124 | 159 | 0.96 | 0.96 | 0.98 | 0.85 | 0.96 | 0.96 | 109 | 117 | 99 | 100 | " |
| 78 | 125 | 157 | 0.96 | 0.96 | 0.98 | 0.84 | 0.96 | 0.97 | 109 | 117 | 99 | 100 | " |
| 79 | 129 | 151 | 0.65 | 0.96 | 0.97 | 0.43 | 0.95 | 0.96 | 100 | 100 | 100 | 100 | Comparative |
| 80 | 130 | 177 | 0.97 | 0.96 | 0.97 | 0.97 | 0.96 | 0.97 | 94 | 95 | 91 | 100 | " |
| 81 | 131 | 170 | 0.88 | 0.96 | 0.98 | 0.75 | 0.96 | 0.97 | 95 | 97 | 89 | 100 | " |
| 82 | 133 | 174 | 0.89 | 0.95 | 0.98 | 0.77 | 0.96 | 0.97 | 95 | 97 | 89 | 100 | " |
| 83 | 131 | 173 | 0.90 | 0.96 | 0.98 | 0.77 | 0.95 | 0.96 | 95 | 97 | 89 | 100 | " |
| 84 | 132 | 171 | 0.90 | 0.96 | 0.98 | 0.76 | 0.96 | 0.97 | 95 | 97 | 89 | 100 | " |
| 85 | 133 | 174 | 0.88 | 0.96 | 0.97 | 0.75 | 0.96 | 0.97 | 95 | 97 | 89 | 100 | " |
| 86 | 130 | 173 | 0.87 | 0.97 | 0.98 | 0.75 | 0.95 | 0.97 | 95 | 97 | 89 | 100 | " |
| 87 | 131 | 173 | 0.88 | 0.96 | 0.98 | 0.75 | 0.96 | 0.97 | 95 | 97 | 89 | 100 | " |

As is apparent also from Table 3, the multicolor photographic element of this invention, in any combination of the cyan couplers of this invention and the dye image stabilizers of this invention, shows a wide color reproduction range, and form a clear dye image. And the photographic element is improved on the prevention of possible discoloration during its storage over a long period and of possible Y-stain by light, and this is improved on the overall dye image preservability.

What is claimed is:

1. In a silver halide photographic light-sensitive material comprising a support having thereon at least one silver halide emulsion layer, said silver halide photographic light-sensitive material wherein said at least one silver halide emulsion layer comprises in combination at least one of those cyan couplers having the following Formula [I], at least one of those cyan couplers having the following Formula [II], and at least one of those compounds having the following Formula [III], Formula [IV] of Formula [V], Formula [I]

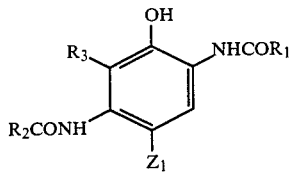

wherein $R_1$ is an alkyl, aryl, cycloalkyl or heterocyclic group; $R_2$ is an alkyl or aryl group; $R_3$ is a hydrogen atom, a halogen atom, an alkyl or alkoxy group; and $Z_1$ is a hydrogen atom or a group that can be split off by the reaction with the oxidized product of an aromatic primary amine-type color developing agent, Formula [II]

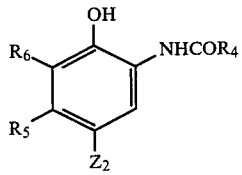

wherein $R_4$ is an alkyl group; $R_5$ is an alkyl group; $R_6$ is a hydrogen atom, a halogen atom or an alkyl group; and $Z_2$ is a hydrogen atom or a group that can be split off by the reaction with the oxidized product of an aromatic primary amine-type color developing agent, Formula [III]

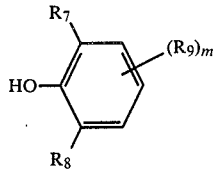

wherein $R_7$ and $R_8$ each is an alkyl group; $R_9$ is an alkyl, —$NHR_9'$, —$SR_9'$ (wherein $R_9'$ is a monovalent organic group) or —$COOR_9''$ group (wherein $R_9''$ is a hydrogen atom or a monovalent organic group); and m is an integer of from zero to 3, Formula [IV]

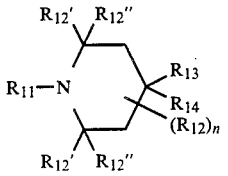

wherein $R_{11}$ is a hydrogen atom, a hydroxyl, oxyl radical, —$SOR_{11}'$, —$SO_2R_{11}'$ (wherein $R_{11}'$ is an alkyl or aryl group), alkyl, hydroxyalkyl, alkenyl, alkynyl or —$COR_{11}''$ group (wherein $R_{11}''$ is a hydrogen atom or a monovalent organic group); $R_{12}$, $R_{12}'$ and $R_{12}''$ each is an alkyl group; $R_{13}$ and $R_{14}$ each is a hydrogen atom or a —OCOR''' group (wherein R''' is a monovalent organic group), the $R_{13}$ and $R_{14}$ being allowed together to form a heterocyclic group; and n is an integer of from zero to 4, Formula [V]

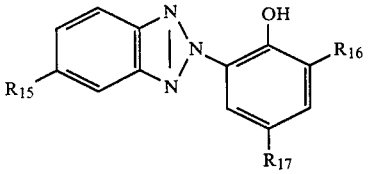

wherein $R_{15}$, $R_{16}$ and $R_{17}$ may be either the same as or different from one another and each is a hydrogen atom, a halogen atom, a hydroxyl, nitro, alkyl, aryl, alkoxy, aryloxy or alkenyl group.

2. The light-sensitive material according to claim 1, wherein said Formula [I] is represented by the following Formula [VI]:

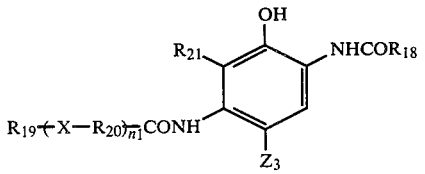

wherein $R_{18}$ represents a phenyl group; $R_{19}$ represents an alkyl group or an aryl group; $R_{20}$ represents an alkylene group, $R_{21}$ represents a hydrogen atom or a halogen atom; X represent a divalent group; $Z_3$ represents a hydrogen atom or a group which can be split off by the reaction with the oxidized product of an aromatic primary amine-type color developing agent; and $n_1$ represents an integer of 0 to 4.

3. The light-sensitive material according to claim 2, wherein $n_1$ in Formula [VI] represents an integer of 0 or 1.

4. The light-sensitive material according to claim 2, wherein X in Formula [VI] represents a divalent group selected from the group consisting of —O—, —S—, —SO— and —$SO_2$—.

5. The light-sensitive material according to claim 2, wherein $R_{20}$ is an alkylene group having from 1 to 12 carbon atoms.

6. The light-sensitive material according to claim 2, wherein $Z_3$ in Formula [VI] represents chlorine atom or a fluorine atom.

7. The light-sensitive material according to claim 2, wherein $R_{18}$ in Formula [VI] represents a phenyl group substituted by a halogen atom.

8. The light-sensitive material according to claim 1, wherein said Formula [II] in represented by the following Formula [VII]:

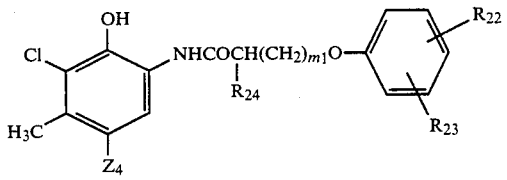

wherein $R_{22}$ and $R_{23}$ represent a hydrogen atom, an alkyl group, an alkoxy group, provided that the sum of the number of carbon atoms of $R_{22}$ and $R_{23}$ is from 8 to 16; $R_{24}$ represents a hydrogen atom or an alkyl group; $m_1$ represents an integer of from 0 to 2; $Z_4$ represents a hydrogen atom or a group that can be split off by the reaction with the oxidized product of an aromatic primary amine-type color developing agent.

9. The light-sensitive material according to claim 1, wherein said Formula [III] in represented by the following Formula [VIII]:

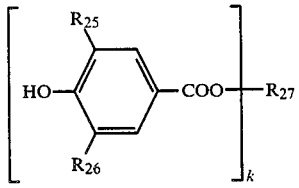

wherein $R_{25}$ and $R_{26}$ represent an alkyl group having from 3 to 8 carbon atoms; $R_{27}$ represents a k-valent organic group; and k represents an integer of from 1 to 6.

10. The light-sensitive material according to claim 1, wherein said Formula [IV] is represented by the following Formula [IX]:

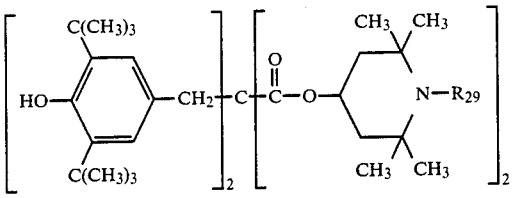

wherein $R_{29}$ represents an alkyl group, an alkenyl group, an alkynyl group or an acyl group.

11. The light-sensitive material according to claim 1, wherein said at least one silver halide emulsion layer comprises in combination at least one cyan coupler of Formula [I], at least one cyan coupler of Formula [II], and at least one compound of Formula [III] or Formula [IV].

* * * * *

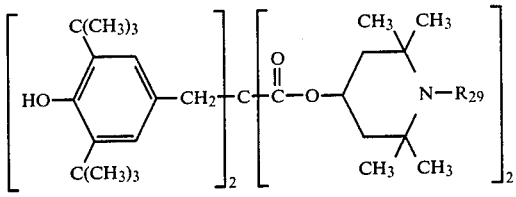

wherein $R_{29}$ represents an alkyl group, an alkenyl group, an alkynyl group or an acyl group.

11. The light-sensitive material according to claim 1, wherein said at least one silver halide emulsion layer comprises in combination at least one cyan coupler of Formula [I], at least one cyan coupler of Formula [II], and at least one compound of Formula [III] or Formula [IV].

* * * * *